US012146291B2

(12) United States Patent
Hayakawa et al.

(10) Patent No.: US 12,146,291 B2
(45) Date of Patent: Nov. 19, 2024

(54) WORK MACHINE

(71) Applicant: HITACHI CONSTRUCTION MACHINERY CO., LTD., Tokyo (JP)

(72) Inventors: Naoki Hayakawa, Ushiku (JP); Shiho Izumi, Hitachinaka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 323 days.

(21) Appl. No.: 17/639,921

(22) PCT Filed: Mar. 5, 2021

(86) PCT No.: PCT/JP2021/008785

§ 371 (c)(1),
(2) Date: Mar. 3, 2022

(87) PCT Pub. No.: WO2021/192932

PCT Pub. Date: Sep. 30, 2021

(65) Prior Publication Data

US 2022/0333338 A1 Oct. 20, 2022

(30) Foreign Application Priority Data

Mar. 24, 2020 (JP) ..... 2020-053351

(51) Int. Cl.
*E02F 3/43* (2006.01)
*E02F 9/20* (2006.01)

(52) U.S. Cl.
CPC ..... *E02F 3/43* (2013.01); *E02F 9/2029* (2013.01)

(58) Field of Classification Search
None
See application file for complete search history.

(56) References Cited

U.S. PATENT DOCUMENTS

2018/0230671 A1 8/2018 Wu
2020/0011029 A1 1/2020 Sano et al.
2020/0131731 A1 4/2020 Wu et al.

FOREIGN PATENT DOCUMENTS

CN 105518226 A * 4/2016 ..... E02F 9/123
JP 2006200185 A * 8/2006
(Continued)

OTHER PUBLICATIONS

International Preliminary Report on Patentability received in corresponding International Application No. PCT/JP2021/008785 dated Oct. 6, 2022.

(Continued)

*Primary Examiner* — Khoi H Tran
*Assistant Examiner* — Bryant Tang
(74) *Attorney, Agent, or Firm* — MATTINGLY & MALUR, PC

(57) ABSTRACT

A controller determines whether or not a work device is in a ground contact state, by using detection data of a pressure sensor and at least one balance relation between forces or moments acting on the work device, and generate partial shape data of a work object formed by the work device, on the basis of a movement locus of a monitoring point set to the work device and an external shape of the work device in a ground contact period in which the work device is determined to be in the ground contact state, and update the present-condition shape data of the work object on the basis of the partial shape data.

11 Claims, 17 Drawing Sheets

(56) References Cited

FOREIGN PATENT DOCUMENTS

| | | | | | |
|---|---|---|---|---|---|
| JP | 2017115369 | A | * | 6/2017 | |
| WO | WO-2014167740 | A1 | * | 10/2014 | ..... E02F 3/28 |
| WO | 2017/047695 | A1 | | 3/2017 | |
| WO | 2018/174154 | A1 | | 9/2018 | |
| WO | 2019/009341 | A | | 1/2019 | |
| WO | WO-2019230045 | A1 | * | 12/2019 | ..... E02F 3/7609 |

OTHER PUBLICATIONS

International Search Report of PCT/JP2021/008785 dated May 18, 2021.

* cited by examiner (a) EXCAVATING OPERATION (b) TAMPING OPERATION (c) BUMPING OPERATION

WORK MACHINE

TECHNICAL FIELD

The present invention relates to a work machine such as a hydraulic excavator that has a work device.

BACKGROUND ART

Conventionally, in a field of work machines typified by hydraulic excavators, there is known a computerized construction supporting work machine which realizes construction with high efficiency and high accuracy by using target surface data in which a completed shape of a construction object is defined three-dimensionally. For example, some hydraulic excavators supporting computerized construction have a machine guidance function of displaying, on a monitor, the positions and postures of each front implement member (a boom, an arm, and a bucket) constituting a work device and a machine body together with target surface data on the periphery of the machine body and a machine control function of controlling at least one actuator such that the bucket moves along a target surface at a time of an excavating operation.

In recent years, a move has spread to record position information (predetermined three-dimensional coordinate information) of the work device, which is computed to provide the above functions, as construction history data together with time information, and utilize the construction history data. As a typical example thereof, there is a case in which data (terrain profile data) of a terrain profile (completed construction part) formed by the hydraulic excavator (work device) is generated from locus information (time series of position information) of the bucket, which is recorded in the construction history data, and the generated data is utilized in completed amount partial payment or completed amount management in dredging work.

As such a method of generating the terrain profile data on the basis of the construction history data, there has been proposed a method in which a completed construction part information processing system described in Patent Document 1 detects an arm crowding operation on the basis of a pilot pressure and an arm cylinder pressure and updates the terrain profile data (completed construction part information) on the basis of a result of measurement of the three-dimensional position of a measurement point (monitoring point) set to the work device in advance.

PRIOR ART DOCUMENT

Patent Document

Patent Document 1: JP-2006-200185-A

SUMMARY OF THE INVENTION

Problem to be Solved by the Invention

The method described in Patent Document 1 updates the terrain profile data (data on the present-condition shape of the construction object) by using the position information of the monitoring point (for example, a distal end of the bucket) while the arm crowding operation is detected, but the method does not determine whether or not the work device (bucket) is actually performing the excavating operation. Therefore, even when the arm crowding operation is performed in the air and the excavating operation is not actually performed, for example, the terrain profile data is generated from the position information of the monitoring point at the time. That is, there is a possibility of recording a shape different from an actual shape as the terrain profile data.

The present invention has been made in view of the above-described circumstances. It is an object of the present invention to provide a work machine that can generate present-condition shape data close to the shape of an actual construction object on the basis of construction history data.

Means for Solving the Problem

The present application includes a plurality of means for solving the above-described problems. To cite an example of the means, there is provided a work machine including a machine body, a work device attached to the machine body, a machine body position computing device configured to compute a position of the machine body, a posture sensor that detects a posture of the work device, a driving state sensor that detects driving states of a plurality of actuators that drive the work device, and a controller configured to compute position information of a monitoring point set to the work device, on the basis of the position of the machine body, the machine body position being computed by the machine body position computing device, and a position of the work device, the work device position being computed from detection data of the posture sensor, and update present-condition shape data of a work object of the work device by using the position information; the controller being configured to determine whether or not the work device is in a ground contact state, by using detection data of the driving state sensor and at least one balance relation between forces or moments acting on the work device, and generate partial shape data of the work object formed by the work device, on the basis of a movement locus of the monitoring point set to the work device and an external shape of the work device in a ground contact period in which the work device is determined to be in the ground contact state, and update the present-condition shape data of the work object on the basis of the partial shape data.

Advantage of the Invention

According to the present invention, it is possible to provide a user with present-condition shape data close to the shape of an actual construction object.

MODE FOR CARRYING OUT THE INVENTION

An embodiment of the present invention will hereinafter be described with reference to the drawings. It is to be noted that while a hydraulic excavator whose attachment at a distal end of a work device is a bucket 4 will be illustrated in the following, the present invention may be applied to hydraulic excavators having an attachment other than a bucket and to work machines such as bulldozers.

(General Configuration of Hydraulic Excavator)

Figure 1:
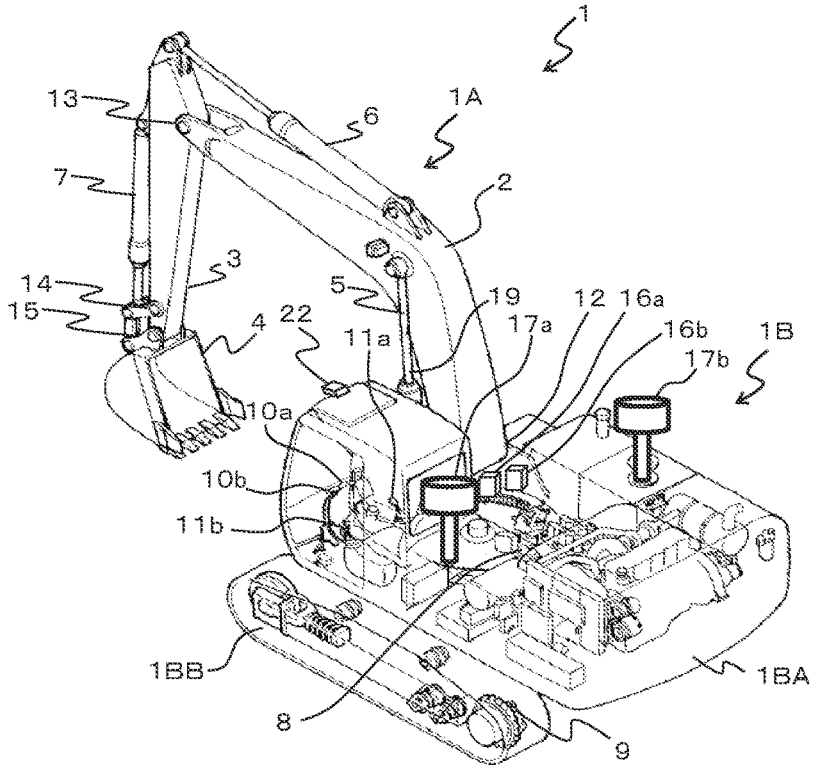
FIG. 1 is a configuration diagram of a hydraulic excavator according to an embodiment of the present invention.

FIG. 1 is a configuration diagram of a hydraulic excavator according to an embodiment of the present invention. As depicted in FIG. 1, the hydraulic excavator 1 includes an articulated work device (front work device) 1A formed by coupling a plurality of front implement members (a boom 2, an arm 3, and a bucket 4) each rotating in a vertical direction to each other and a machine body 1B including an upper swing structure 1BA and a lower track structure 1BB.

A proximal end of the boom 2 located on the proximal end side of the work device 1A is attached to a front portion of the upper swing structure 1BA in such a manner as to be rotatable in an upward-downward direction. The upper swing structure 1BA is swingably attached to an upper portion of the lower track structure 1BB.

Also attached to the upper swing structure 1BA are a controller 100 that has functions of computing the position data (position information) of a plurality of monitoring points set to the work device 1A, and updating present-condition terrain profile data (the present-condition terrain profile data will be referred to also as present-condition shape data, and the present-condition shape data is also data defining the shape of a work object (terrain profile) of the work device 1A) on the periphery of the hydraulic excavator 1 by using the position data; and a present-condition terrain profile data input device 22 for obtaining the present-condition terrain profile data, and inputting the present-condition terrain profile data to the controller 100 in the hydraulic excavator 1. As an example of the present-condition terrain profile data input device 22, a stereo camera is attached to the hydraulic excavator 1 depicted in FIG. 1. However, a publicly known device such as a three-dimensional laser scanner can be used as the present-condition terrain profile data input device 22. In addition, a flash memory, a removable medium, or the like storing the present-condition terrain profile data can also be used as the present-condition terrain profile data input device 22.

The boom 2, the arm 3, the bucket 4, the upper swing structure 1BA, and the lower track structure 1BB respectively constitute driven members driven by a boom cylinder 5, an arm cylinder 6, a bucket cylinder 7, a swing hydraulic motor 8, and a left and a right travelling hydraulic motor 9 (hydraulic actuators). Operations of these plurality of driven members are controlled by control signals (for example, pilot pressures or electric signals) generated when an operator operates a travelling right lever 10*a*, a travelling left lever 10*b*, an operation right lever 11*a*, and an operation left lever 11*b* (these levers may be referred to collectively as operation levers 10 and 11) installed in a cab on the upper swing structure 1BA.

Figure 3:
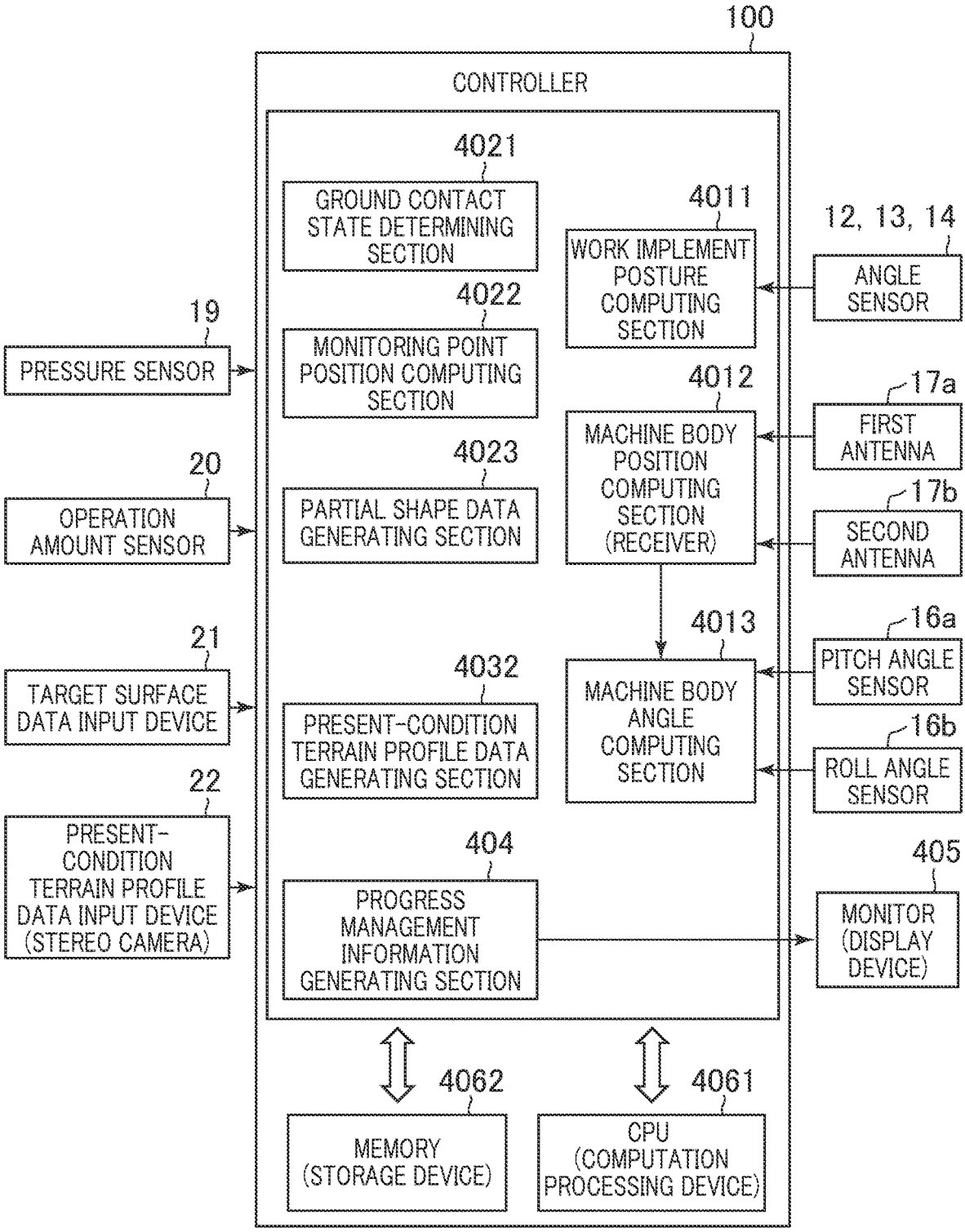
FIG. 3 is a system configuration diagram of the hydraulic excavator according to the embodiment of the present invention.

Amounts of operation on the hydraulic actuators 5 to 9, which are input by the operator via the operation levers 10 and 11, are detected by a plurality of operation amount sensors 20, and are input to the controller 100 (see FIG. 3). In a case where the control signals output by the operation levers 10 and 11 are pilot pressures, pressure sensors can be used as the operation amount sensors 20.

As driving state sensors of the boom cylinder 5, a plurality of pressure sensors 19 for detecting hydraulic operating fluid pressures Pr and Pb on the rod side and bottom side of the boom cylinder 5 are attached to the boom cylinder 5. The driving state of the boom cylinder 5 can be determined from the hydraulic operating fluid pressures Pr and Pb detected by the pressure sensors 19.

The control signals that drive the above-described plurality of driven members include not only the control signals output by the operation of the operation levers 10 and 11 but also pilot pressures output when a part (pressure increasing valve) of a plurality of proportional solenoid valves (not depicted) included in the hydraulic excavator 1 operate independently of the operation of the operation levers 10 and 11 under a predetermined condition; and pilot pressures obtained by reducing pilot pressures output by the operation of the operation levers 10 and 11 when a part (pressure reducing valve) of the plurality of proportional solenoid valves operate. The pilot pressures thus output from the plurality of proportional solenoid valves (the pressure increasing valve and the pressure reducing valve) can activate what is generally called machine control that operates the boom cylinder 5, the arm cylinder 6, and the bucket cylinder 7, according to a predetermined condition.

The work device 1A has a boom angle sensor 12 attached to a boom pin, an arm angle sensor 13 attached to an arm pin, and a bucket angle sensor 14 attached to a bucket link 15 such a manner as to be able to measure rotation angles α, β, and γ (see FIG. 2) of the boom 2, the arm 3, and the bucket 4. Attached to the upper swing structure 1BA are a machine body forward-rearward inclination angle sensor (pitch angle sensor) 16*a* that detects a pitch angle θp (see FIG. 2) as an inclination angle in a forward-rearward direction of the upper swing structure 1BA (machine body 1B) with respect to a reference plane (for example, a horizontal plane); and a machine body left-right inclination angle sensor (roll angle sensor) 16*b* that detects a roll angle φ (not depicted) as an inclination angle in a left-right direction of the upper swing structure 1BA (machine body 1B). Incidentally, a sensor such as an IMU (Inertial Measurement Unit), a potentiometer, or a rotary encoder may be used as these angle sensors, or the lengths of the cylinders 5, 6, and 7 may be measured by a stroke sensor, and converted into the rotation angles. In addition, the bucket angle sensor 14 may be attached to the bucket 4 instead of to the bucket link 15.

A first GNSS antenna 17*a* and a second GNSS antenna 17*b* are arranged on the upper swing structure 1BA. The first GNSS antenna 17*a* and the second GNSS antenna 17*b* are antennas for RTK-GNSS (Real Time Kinematic—Global Navigation Satellite Systems). The first GNSS antenna 17*a* and the second GNSS antenna 17*b* receive radio waves (navigation signals) transmitted from a plurality of GNSS satellites (positioning satellites), and output the radio waves (navigation signals) to a receiver 4012 (see FIG. 3).

The receiver (machine body position computing device) 4012 computes the positions of the first GNSS antenna 17*a* and the second GNSS antenna 17*b* in a site coordinate system set to a work site, on the basis of the navigation signals received by the first GNSS antenna 17*a* and the second GNSS antenna 17*b*. On the basis of the computed positions of the first GNSS antenna 17*a* and the second GNSS antenna 17*b*, the receiver 4012 can compute an azimuth angle θy (not depicted) of the upper swing structure 1BA and the work device 1A. It is to be noted that while description will be made using the receiver 4012 that outputs coordinate values in the site coordinate system in the present embodiment, it suffices for the receiver 4012 to be able to output coordinate values in at least one coordinate system of a geographic coordinate system, a plane rectangular coordinate system, a geocentric rectangular coordinate system, or the site coordinate system as the positions of the first GNSS antenna 17*a* and the second GNSS antenna 17*b*. In addition, coordinate values in the geographic coordinate system include a latitude, a longitude, and an ellipsoidal height. Coordinate values in the plane rectangular coordinate system, the geocentric rectangular coordinate system, and the site coordinate system are coordinate values in a three-dimensional rectangular coordinate system formed by X-, Y-, and Z-coordinates or the like. The geographic coordinate system coordinate values can be transformed into a three-dimensional rectangular coordinate system such as the plane rectangular coordinate system by using a Gauss-Krueger isometric projection or the like. In addition, the plane rectangular coordinate system, the geocentric rectangular coordinate system, and the site coordinate system can be mutually transformed by using an affine transformation or a Helmert transformation or the like.

Figure 2:
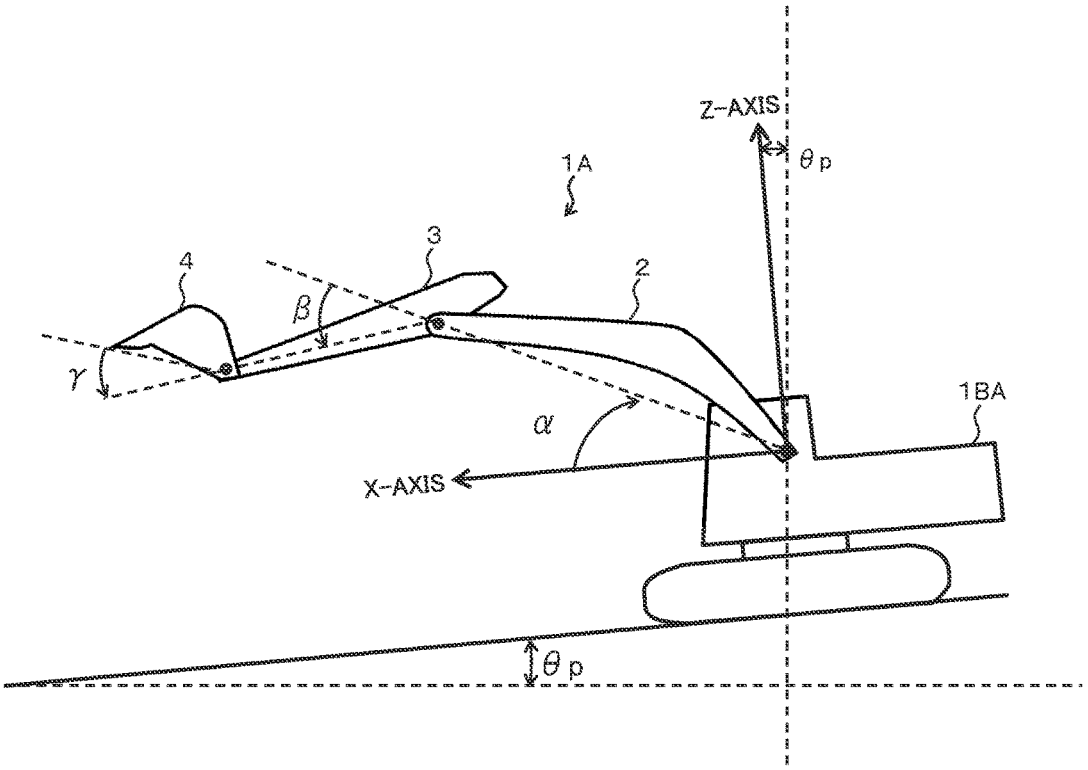
FIG. 2 is a diagram of assistance in explaining the rotation angle of each front implement member, the inclination angle of an upper swing structure, and a machine body coordinate system.

An X-axis and a Z-axis provided in FIG. 2 represent a machine body coordinate system in which a point on an axis (for example, a central point) of the boom pin is set as an origin, an upward direction of the machine body is set as the Z-axis, a forward direction of the machine body is set as the X-axis, and a right direction of the machine body is set as a Y-axis.

The machine body coordinate system and the site coordinate system can be mutually transformed by using a coordinate transformation parameter that can be obtained by a publicly known method. This coordinate transformation parameter can, for example, be obtained from a pitch angle θ and a roll angle φ of the machine body 1B, the pitch angle θ and the roll angle φ being obtained by the inclination angle sensors 16*a* and 16*b*, the azimuth angle θy computed by the receiver 4012 from a positional relation between the first and second GNSS antennas 17*a* and 17*b*, coordinate values in the machine body coordinate system of the first GNSS antenna 17*a*, and coordinate values in the site coordinate system of the first GNSS antenna 17*a* on the basis of GNSS positioning (preferably RTK-GNSS positioning) of the first GNSS antenna 17*a*, when the coordinate values in the machine body coordinate system of the first GNSS antenna 17*a* are known.

Position data in the machine body coordinate system of freely-selected monitoring points on the work device 1A can be computed from the rotation angles α, β, and γ of the boom 2, the arm 3, and the bucket 4 and dimension values Lbm, Lam, and Lbk of the respective front implement members 2, 3, and 4. It is therefore possible to obtain position data in the site coordinate system of the freely-selected monitoring points.

The upper swing structure 1BA includes a target surface data input device 21 for inputting data on a target surface (target surface data) on which the target shape (completed shape) of a construction object (for example, a soil, a rock, or the like) for the work device 1A is defined. The target surface data input device 21, for example, inputs, to the controller 100, the target surface data obtained from the outside (for example, a computer or a server storing design data) via a semiconductor memory such as a flash memory or wireless communication.

A monitor 405 is installed in the cab of the hydraulic excavator 1. A screen of the monitor 405 may display posture data of the work device 1A which posture data is computed from the output of the various kinds of angle sensors 12, 13, 14, and 16, an image of the work device 1A as viewed from the side on the basis of position data of the upper swing structure 1BA which position data is computed from the signals received by the first and second GNSS antennas 17*a* and 17*b* and the like, and a sectional shape of the target surface.

(Configuration on Periphery of Controller 100)

FIG. 3 is a system configuration diagram of the hydraulic excavator 1 according to the present embodiment. As depicted in FIG. 3, the hydraulic excavator 1 according to the present embodiment includes the controller 100, the plurality of pressure sensors 19, the plurality of operation amount sensors 20, the target surface data input device 21, the present-condition terrain profile data input device 22, the angle sensors 12, 13, and 14, the first and second GNSS antennas 17*a* and 17*b*, the machine body inclination angle sensors (the pitch angle sensor and the roll angle sensor) 16*a* and 16*b*, and a monitor 45.

Usable as the controller 100 is, for example, a computer including a computation processing device 4061 such as a CPU, a storage device 4062 including a semiconductor storage device such as a RAM or a ROM or a magnetic storage device such as an HDD, and an input-output interface (not depicted) that exchanges information with the various kinds of sensors, the actuators, and the like. The controller 100 can be constituted of a single or a plurality of computers. In addition, a part or all of the controller 100 may be constituted by a server or the like connected to various kinds of devices on the hydraulic excavator 1 via a network.

The controller 100 functions as a work implement posture computing section 4011, a machine body angle computing section 4013, a ground contact state determining section 4021, a monitoring point position computing section 4022, a partial shape data generating section 4023, a present-condition terrain profile data generating section 4032, and a progress management information generating section 404 by making the computation processing device 4061 execute a program stored in the storage device 4062. That is, each section depicted in a rectangular shape in the controller 100 in FIG. 3 is obtained by classifying functions exerted by computation processing performed by the controller 100 into blocks. Incidentally, the receiver 4012 that performs GNSS positioning using the first and second GNSS antennas 17*a* and 17*b* may be a machine body position computing section 4012 as a part of the functions in the controller 100 as depicted in FIG. 3, or may be a device independent of the controller 100, as described above. In the following, description will be made of details of processing performed by each section in the controller 100.

(Work Implement Posture Computing Section 4011)

The work implement posture computing section 4011 receives sensor values of the boom angle sensor 12, the arm angle sensor 13, and the bucket angle sensor 14 as input, and computes the rotation angles α, β, and γ (see FIG. 2) of the boom 2, the arm 3, and the bucket 4 as posture information of the work device 1A. Angle data computed here can be used as posture data of the work device 1A.

(Machine Body Position Computing Section (Receiver) 4012)

The machine body position computing section (receiver) 4012 computes the position coordinates (position data) of the first GNSS antenna 17*a* and the second GNSS antenna 17*b* in the site coordinate system on the basis of the navigation signals received by the first GNSS antenna 17*a* and the second GNSS antenna 17*b*. Position data computed here can be used as position data of the machine body 1B.

(Machine Body Angle Computing Section 4013)

The machine body angle computing section 4013 computes the azimuth angle θy of the work device 1A (upper swing structure 1BA) in the site coordinate system on the basis of the position coordinates of the first GNSS antenna 17*a* and the second GNSS antenna 17*b* in the site coordinate system which position coordinates are computed by the machine body position computing section 4012. In addition, the machine body angle computing section 4013 receives sensor values of the machine body forward-rearward inclination angle sensor (pitch angle sensor) 16*a* and the machine body left-right inclination angle sensor (roll angle sensor) 16*b* as inputs, and computes a roll angle θr and a pitch angle θp of the upper swing structure 1BA. Angle data computed here can be used as posture data of the machine body 1B.

(Ground Contact State Determining Section 4021)

The ground contact state determining section 4021 receives, as inputs, the position data and the posture data of the work device 1A and the machine body 1B, the position data and the posture data being computed by the work implement posture computing section 4011, the machine body position computing section 4012, and the machine body angle computing section 4013, and data on the hydraulic operating fluid pressures Pr and Pb of the boom cylinder 5 (pressure data), the pressure data being output by the pressure sensors 19, determines whether or not the work device 1A is in a ground contact state, and outputs a result of the determination (ground contact state determination result).

More specifically, the ground contact state determining section 4021 determines a ground contact state by computing at least one of a reaction force of the ground or a moment caused by the reaction force of the ground with use of the signals detected by the pressure sensors 19 and at least one balance relation between forces or moments acting on the work device 1A, and determines whether a result of the computation is equal to or more than a predetermined threshold value.

The ground contact state determining section 4021 in the present embodiment first checks whether position information of the bucket 4 is updated from the position data and the posture data of the work device 1A and the machine body 1B. Then, when the position information of the bucket 4 is updated, the ground contact state determining section 4021 computes the reaction force of the ground with use of the signals detected by the pressure sensors 19 and a balance relation between moments about a boom foot pin. When the computed reaction force is equal to or more than a predetermined threshold value, the ground contact state determining section 4021 determines that the bucket 4 is in the ground contact state.

A method of deriving the reaction force of the ground will be described in the following with reference to FIGS. 4 to 6.

Figure 4:
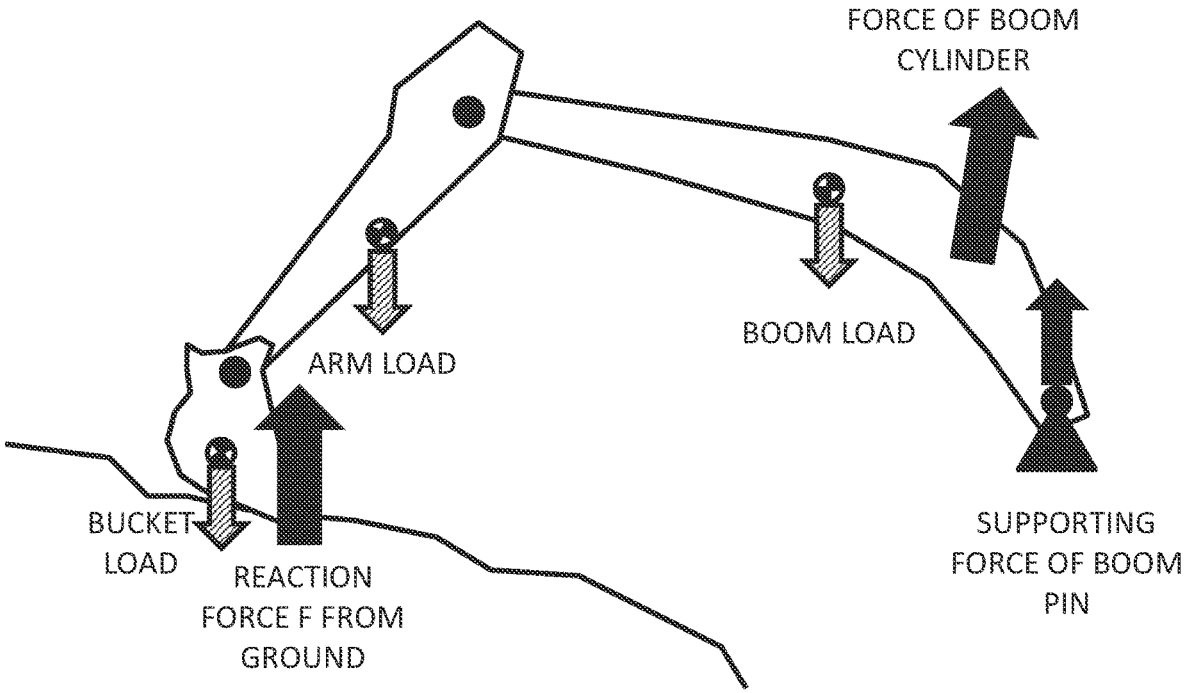
FIG. 4 is a diagram of assistance in explaining forces acting on a work device.

As depicted in FIG. 4, not only a supporting force of the boom foot pin but also loads corresponding to the masses of the boom 2, the arm 3, and the bucket 4, the reaction force F from the ground, and a force of the boom cylinder 5 act on the work device 1A. Letting MF be a moment caused by the reaction force F from the ground, letting Mcyl be a moment caused by a force Fcyl of the boom cylinder 5, and letting Mbm, Mam, and Mbk be moments caused respectively by loads on the boom 2, the arm 3, and the bucket 4, these moments are balanced as in the following Equation 1.

[Math. 1]

$$M_F+M_{cyl}=M_{bm}+M_{am}+M_{bk} \quad \text{Equation 1}$$

[Math. 2]

$$M_F=F\times X_{bkmp} \quad \text{Equation 2}$$

Here, the moment caused by the reaction force F from the ground can be expressed as in the above Equation 2. Thus, from Equation 1 and Equation 2, the reaction force F from the ground can be obtained by the following Equation 3. An X-coordinate in the machine body coordinate system of a position on which the reaction force F from the ground can be estimated to act is set as Xbkmp. The position on which the reaction force from the ground can be estimated to act may be a monitoring point estimated by the monitoring point position computing section 4022 to be described later, or may be fixed at a specific position such as a claw tip of the bucket.

[Math. 3]

$$F = \frac{M_{bm} + M_{am} + M_{bk} - M_{cyl}}{X_{bkmp}} \quad \text{Equation 3}$$

Xbkmp can be derived by the following Equation 4 by using a boom length Lbm, an arm length Lam, a distance Lbkmp from the bucket pin to a monitoring point, and an angle γmp formed between a straight line connecting the bucket monitoring point and the bucket pin to each other and a straight line connecting the bucket pin and the bucket claw tip to each other.

[Math. 4]

$$X_{bkmp}=L_{bm}\cos\alpha+L_{amg}\cos(\alpha+\beta)+L_{bkmp}\cos(\alpha+\beta+\gamma+\gamma_{mp}) \quad \text{Equation 4}$$

Figure 5:
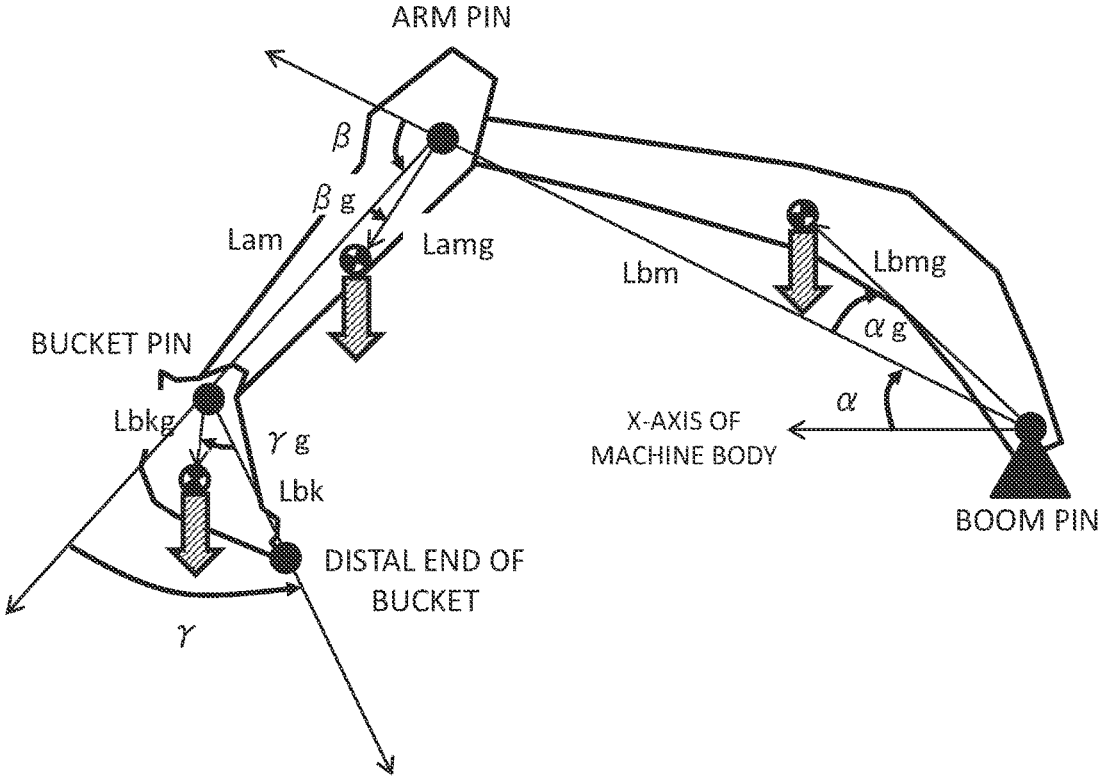
FIG. 5 is a diagram of assistance in explaining the length and angle of each part of the work device.

The lengths and angles of the parts are depicted in FIG. 5. Of the moments in Equation 3, Mbm, Mam, and Mbk as the moments caused by the loads can be obtained by the following Equations 5, 6, and 7, where mbm, mam, and mbk in the following Equations 5, 6, and 7 are the masses of the boom 2, the arm 3, and the bucket 4, gz is a Z-axis direction component in the machine body coordinate system of gravity acceleration, α', β', and γ' are angular velocities of the boom 2, the arm 3, and the bucket 4, and fbm, fam, and fbk are functions for calculating inertial forces on the basis of the angular velocities of the boom 2, the arm 3, and the bucket 4. Incidentally, fbm, fam, and fbk may be ignored when the angular velocities of the boom 2, the arm 3, and the bucket 4 are sufficiently low. In addition, X-coordinates Xbmg, Xamg, and Xbkg in the machine body coordinate system of centers of gravity of the boom 2, the arm 3, and the bucket 4, the X-coordinates Xbmg, Xamg, and Xbkg being used in Equations 5 to 7, can be derived by the following Equations 8 to 10, respectively, where Lbmg, Lamg, and Lbkg in the equations are distances from the pins of the respective parts to gravity center positions, and αg, βg, and γg are angles formed between straight lines connecting the gravity center positions of the respective parts to the base pins of the respective parts and straight lines connecting the distal ends of the respective parts to the bases (see FIG. 5).

[Math. 5]

$$M_{bm}=m_{bm}\cdot g_z\cdot X_{bmg}+f_{bm}(\dot{\alpha})\cdot X_{bmg} \quad \text{Equation 5}$$

[Math. 6]

$$M_{am}=m_{am}\cdot g_z\cdot X_{amg}+f_{am}(\dot{\alpha}+\dot{\beta})\cdot X_{amg} \quad \text{Equation 6}$$

[Math. 7]

$$M_{bk}=m_{bk}\cdot g_z\cdot X_{bkg}+f_{bk}(\dot{\alpha}+\dot{\beta}+\dot{\gamma})\cdot X_{bkg} \quad \text{Equation 7}$$

[Math. 8]

$$X_{bmg}=L_{bmg}\cos(\alpha+\alpha_g) \quad \text{Equation 8}$$

[Math. 9]

$$X_{amg}=L_{bm}\cos\alpha+L_{amg}\cos(\alpha+\beta+\beta_g) \quad \text{Equation 9}$$

[Math. 10]

$$X_{bkg}=L_{bm}\cos\alpha+L_{am}\cos(\alpha+\beta)+L_{bkg}\cos(\alpha+\beta+\gamma+\gamma_g) \quad \text{Equation 10}$$

Figure 6:
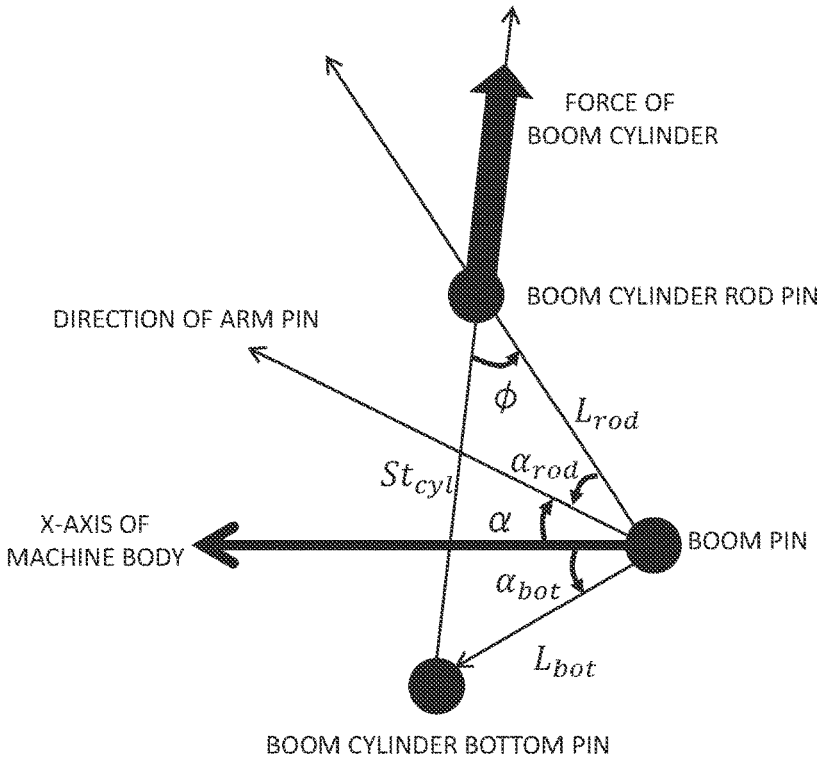
FIG. 6 is a diagram of assistance in explaining the length and angle of each part in a portion around a boom cylinder.

FIG. 6 depicts the lengths and angles of parts in a portion around the boom cylinder. of the moments in the above Equation 3, the moment Mcyl caused by the boom cylinder 5 can be derived by the following Equation 11. The force Fcyl in Equation 11 can be expressed as in the following Equation 12 by using the hydraulic operating fluid pressures Pr and Pb on the rod side and bottom side of the boom cylinder 5, the hydraulic operating fluid pressures Pr and Pb being detected by the pressure sensors 19, and respective pressure receiving areas Sr and Sb. In addition, Lrod in the following Equation 11 is a distance between the boom pin and a boom cylinder rod pin, and φ is an angle formed between a straight line connecting the boom pin and the boom cylinder rod pin to each other and a straight line connecting the boom cylinder rod pin and a boom cylinder bottom pin to each other. This φ can be derived by using the following Equation 14 after a length Stcyl of the boom cylinder is obtained as in the following Equation 13 by using a cosine theorem.

[Math. 11]

$$M_{cyl} = F_{cyl} \times L_{rod} \times \sin\varphi \quad \text{Equation 11}$$

[Math. 12]

$$F_{cyl} = P_b \times S_b - P_r \times S_r \quad \text{Equation 12}$$

[Math. 13]

$$St_{cyl} = \sqrt{L_{rod}^2 + L_{bot}^2 - 2\cdot L_{rod}\cdot L_{rod}\cdot\cos(\alpha+\alpha_{rod}+\alpha_{bot})} \quad \text{Equation 13}$$

[Math. 14]

$$\varphi = \cos^{-1}\left(\frac{L_{bot}^2 - L_{rod}^2 - St_{cyl}^2}{2\cdot L_{rod}\cdot St_{cyl}}\right) \quad \text{Equation 14}$$

In the present embodiment, the reaction force F of the ground is derived on the basis of a balance between the moments. However, the reaction force of the ground may be obtained by using a balance between the forces. In that case, the supporting force at the boom pin may be detected by using a load sensor or a strain sensor, and used for the computation.

When the reaction force F of the ground, the reaction force F being obtained as described above, is equal to or more than the predetermined threshold value, the ground contact state determining section 4021 determines that the bucket 4 is in the ground contact state. A period for which the work device 1A (bucket 4) is determined to be in the ground contact state by the ground contact state determining section 4021 may be referred to as a ground contact period.

An appropriate value is set as the threshold value used for the ground contact determination in consideration of the hardness of the ground, work contents, and the like. When excavation work on a soft ground is performed, for example, the reaction force F from the ground during the excavation work is relatively small, and therefore the threshold value is set to be a relatively small value. Conversely, when a hard ground is excavated, the threshold value is set to be a relatively large value. In addition, the threshold value set here does not have to be a fixed value. For example, because a maximum value of a force with which the bucket 4 is pressed against the ground varies according to the position of the bucket, the threshold value may be set as a function of an X-coordinate in the machine body coordinate system or the like. In that case, when a function f(Xkmp) of the threshold value is set to be a certain constant Const multiplied by a reciprocal of Xbkmp as in the following Equation 15, the ground contact state can be determined by comparison between the moment MF caused by the reaction force F from the ground and the constant Const as represented in the following Equation 16. Thus, depending on a threshold value setting condition, the ground contact state may be determined by comparison between the moment caused by the reaction force from the ground and the threshold value without obtaining the reaction force from the ground. Incidentally, the threshold value set here may be set by combining both the reaction force from the ground and the moment caused by the reaction force from the ground.

[Math. 15]

$$F > f(X_{bkmp}) = \frac{Const}{X_{bkmp}} \quad \text{Equation 15}$$

[Math. 16]

$$M_F = F \times X_{bkmp} > Const \quad \text{Equation 16}$$

(Monitoring Point Position Computing Section 4022)

The monitoring point position computing section 4022 computes the positions of a plurality of monitoring points Mpm (see FIG. 7) set on an operation plane 41 (see FIG. 7) of the work device 1A and to the work device 1A, on the basis of the position data and the posture data of the work device 1A and the machine body 1B, the position data and the posture data being computed by the work implement posture computing section 4011, the machine body position computing section 4012, and the machine body angle computing section 4013. The monitoring point position computing section 4022 stores the positions of the plurality of monitoring points Mpm in the storage device 4062. The computation of the positions of the monitoring points Mpm may, for example, be performed at predetermined intervals, or may be performed at predetermined intervals while the operation of the work device 1A is observed. A condition that the computation of the positions of the monitoring points Mpm be performed while the work device 1A is determined to be in the ground contact state by the ground contact state determining section 4021 may be added to these conditions.

Figure 7:
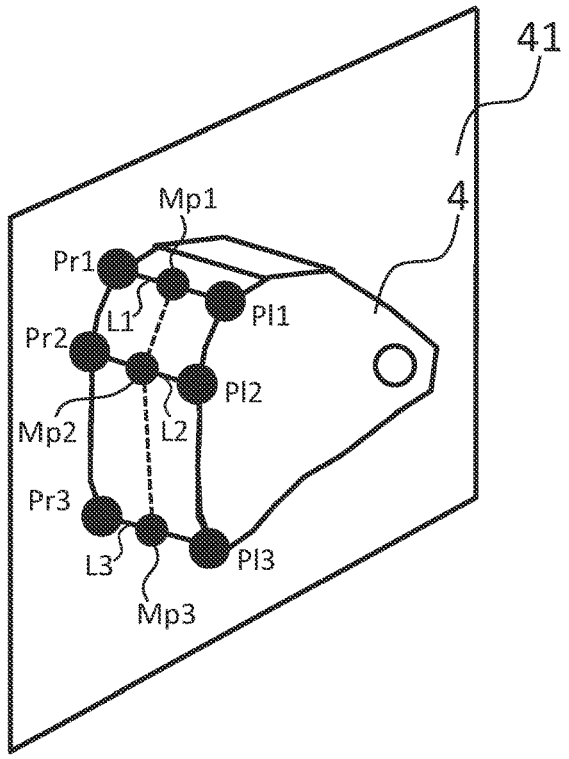
FIG. 7 is a diagram of assistance in explaining a case where monitoring points are set to a bucket.

FIG. 7 is a diagram of assistance in explaining a case where the monitoring points are set to the bucket 4. k monitoring points (k is a positive integer) are set onto each of the external shapes of the left and right side surfaces of the bucket 4. A line segment connecting two monitoring points having a same value of m among monitoring points Plm (m=1 to k) (not depicted) on the left side surface side and monitoring points Prm (m=1 to k) (not depicted) on the right side surface side is set as Lm (m=1 to k). Then, a monitoring point Mpm (m=1 to k) is set at a point at which the line segment Lm intersects the operation plane 41 of the work device 1A, and the monitoring point at time t is set as Mpm(t). When the positions of the monitoring points Plm and Prm in the coordinate system set to the bucket 4 are measured in advance, for example, the position of the monitoring point Mpm(t) at time t can be computed from the position data and the posture data of the work device 1A and the machine body 1B.

(Partial Shape Data Generating Section 4023)

The partial shape data generating section 4023 generates partial shape data 65 of the work object formed by the work device 1A, on the basis of a movement locus 63 (see FIG. 8) of at least one monitoring point Mpm and external shapes 61 and 62 of the work device 1A in the ground contact period in which the work device 1A is determined to be in the ground contact state by the ground contact state determining section 4021. The partial shape data 65 can also be said to be data obtained by approximating a part of a present-condition terrain profile by using time series data of the monitoring points Mpm in the ground contact period. It is preferable to set a plurality of monitoring points to the work device 1A. In that case, the external shapes 61 and 62 of the work device 1A are defined by the positions of the plurality of monitoring points.

More specifically, the partial shape data generating section 4023 generates the partial shape data 65 (see FIGS. 9 to 12 and 20) of the work object formed by the work device 1A during a period from a first time (t0) to a second time (t1), on the basis of a first external shape 61 (see FIG. 8) defined by the positions of a plurality of monitoring points Mpm(t0) at the first time (t0) in the ground contact period in which the work device 1A is determined to be in the ground contact state by the ground contact state determining section 4021, a second external shape 62 (see FIG. 8) defined by the positions of a plurality of monitoring points Mpm(t1) at the second time (t1) after the first time in the ground contact period, and the movement loci 63 (see FIG. 8) of the plurality of monitoring points in the period from the first time (t0) to the second time (t1).

Figure 8:
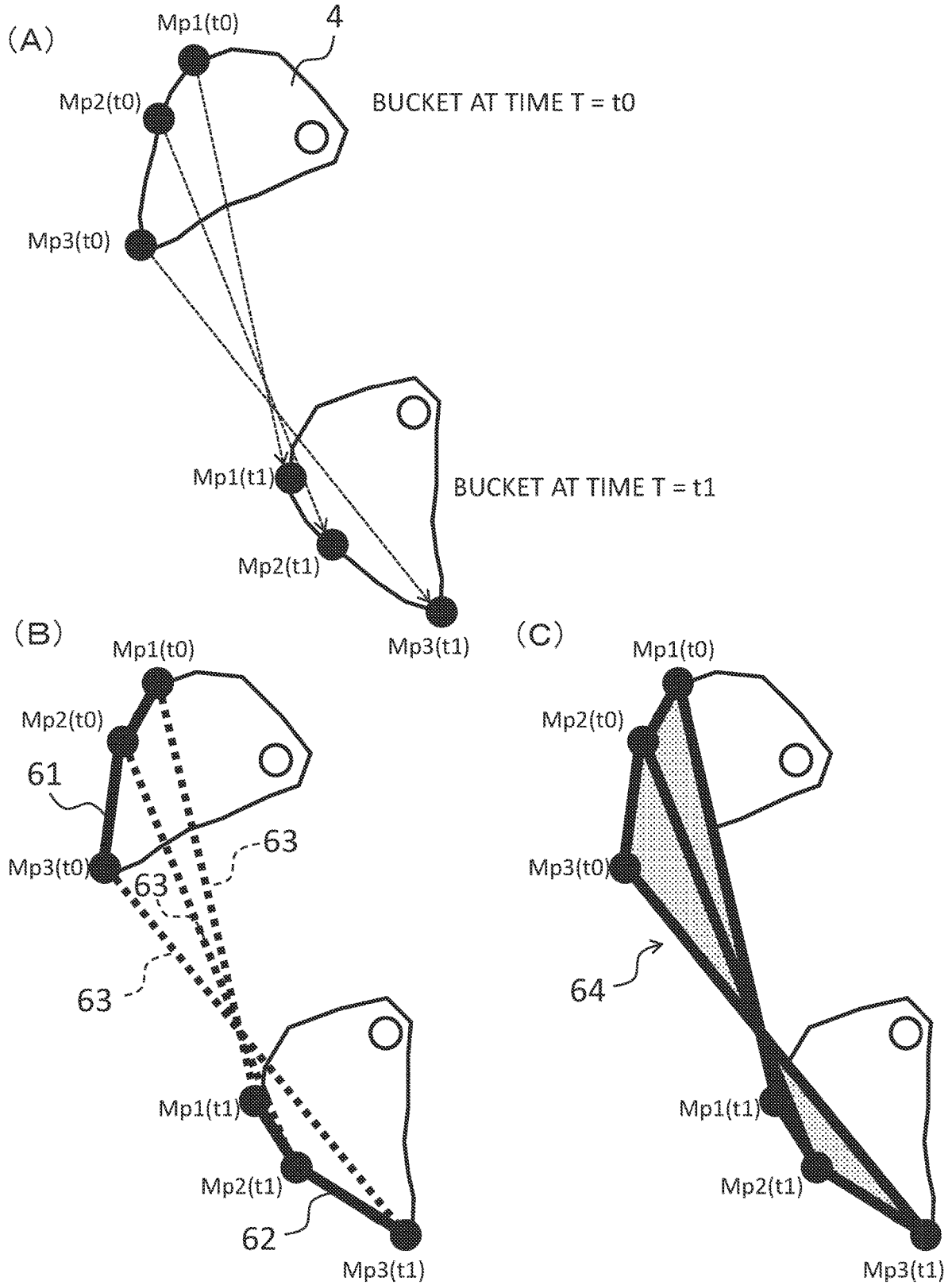
FIG. 8 depicts diagrams depicting the posture of the bucket at a certain time t0 and time t1 at which the position data and posture data of the work device and a machine body are updated immediately after t0.

FIG. 8 depicts the posture of the bucket 4 at a certain time t0 and time t1 at which the position data and the posture data of the work device 1A and the machine body 1B are updated immediately after t0. In the example of the figure, three monitoring points Mp1, Mp2, and Mp3 are set to the bucket 4. As depicted in FIG. 8(B), the first external shape 61 is an external shape of the bucket 4, which is defined by the three monitoring points Mp1, Mp2, and Mp3 at time t0 (first time). The second external shape 62 is an external shape of the bucket 4, which is defined by the three monitoring points Mp1, Mp2, and Mp3 at time t1 (second time). The movement loci 63 are the loci of the monitoring points, which are defined by lines connecting the positions of the monitoring points at time t0 to the positions of the monitoring points at time t1. In addition, as depicted in FIG. 8(C), a region enclosed by the first external shape 61, the second external shape 62, and the movement loci 63 (region provided with dots) will be referred to as a bucket passage region (work device passage region) 64.

Two main methods will next be described as examples of generation of the partial shape data 65 by the partial shape data generating section 4023.

(First Method of Generating Partial Shape Data)

A first generating method will be described with reference to FIGS. 19 and 20.

The partial shape data generating section 4023 obtains a distance from a bucket monitoring point Mpm to the target surface (target surface distance) by using the target surface data stored in the storage device 4062. The computation of the target surface distance may be performed for only a bucket monitoring point Mp closest to the target surface. The partial shape data generating section 4023 computes operation amounts of the operation levers 11*a* and 11*b* for the front implement members 2, 3, and 4 (hydraulic cylinders 5, 6, and 7) on the basis of the detection values of the plurality of operation amount sensors 20. Incidentally, the operation amounts refer to physical quantities that change according to operation contents when the operation levers 11*a* and 11*b* are operated, the physical quantities being pilot pressures or voltages, the angles of inclination of the operation levers 11*a* and 11*b*, or the like, which are detected by the operation amount sensors 20.

Next, the partial shape data generating section 4023 determines an operation of the work device 1A on the basis of the computed target surface distance and the computed operation amounts. As depicted in FIG. 20, the determined operation includes (a) an excavating operation in which the bucket 4 excavates the construction object, (b) a tamping operation in which the construction object is approximated to the shape of the target surface by performing an arm pushing operation or an arm pulling operation in a state in which the bottom surface of the bucket is set in contact with the ground, and (c) a bumping operation in which the construction object is approximated to the shape of the target surface by bumping the bottom surface of the bucket against the construction object by a boom lowering operation. Incidentally, other information (data) than the target surface distance and the operation amounts may be used for the operation determination.

The operation determination in the present embodiment, for example, determines that the excavating operation is performed when an "arm pulling operation amount of the operation lever 11 is equal to or more than a predetermined threshold value" and a "bucket monitoring point Mpm whose target surface distance is a minimum is the bucket claw tip," determines that the bumping operation is performed when a "boom lowering operation amount of the operation lever 11 is equal to or more than a predetermined threshold value" and "arm and bucket operation amounts of the operation lever 11 are less than a predetermined threshold value," and otherwise determines that the tamping operation is performed. Incidentally, appropriate values for the various kinds of threshold values used here may be different according to a tendency of operation of the operator or the like. Therefore, for example, operations such as excavation, bumping, and tamping may be actually performed at least a certain number of times, and settings may be made on the basis of operation amounts at times of the operations.

The partial shape data generating section 4023 decides a region on the work device 1A in which the work device 1A is estimated to be in contact with the construction object (ground contact) (ground contact region), on the basis of a result of the above-described operation determination.

Figure 19:
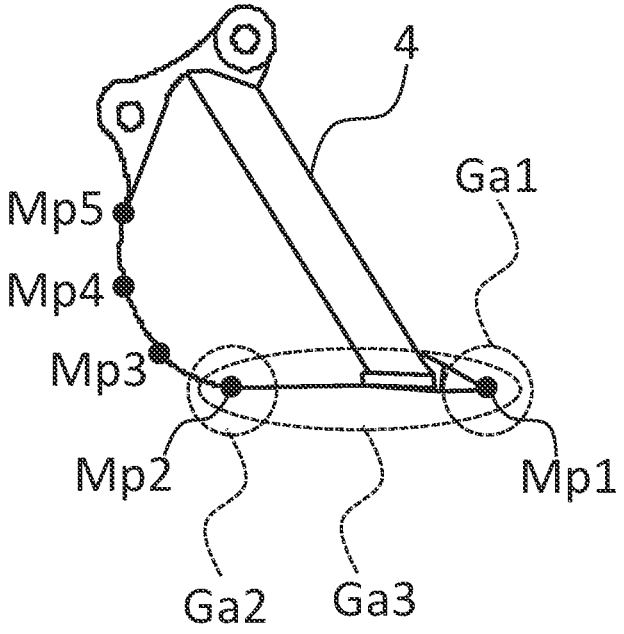
FIG. 19 is a diagram depicting an example of monitoring points and ground contact regions set to the bucket when the first generating method is adopted.
Figure 20:
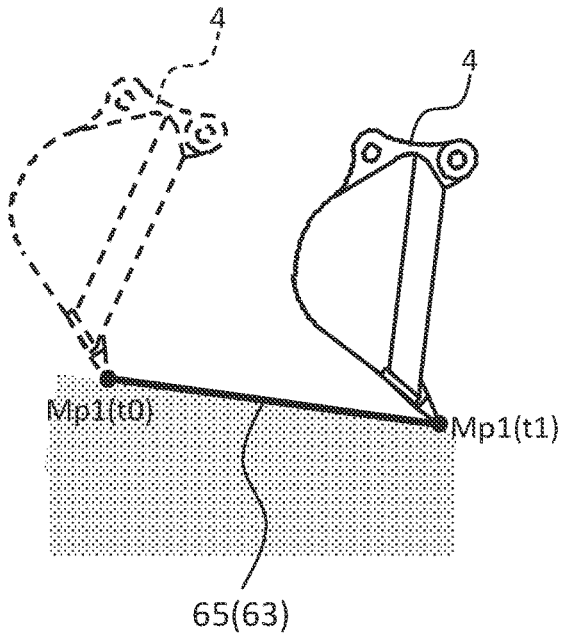
FIG. 20 depicts diagrams each depicting an example of partial shape data of each operation determination result.
Figure 20:
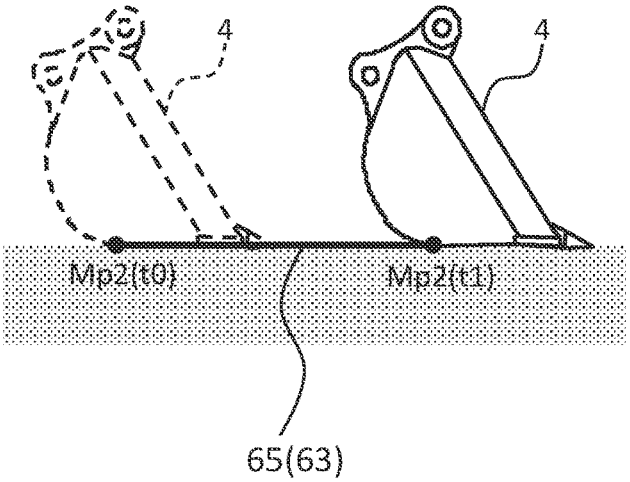
Figure 20:
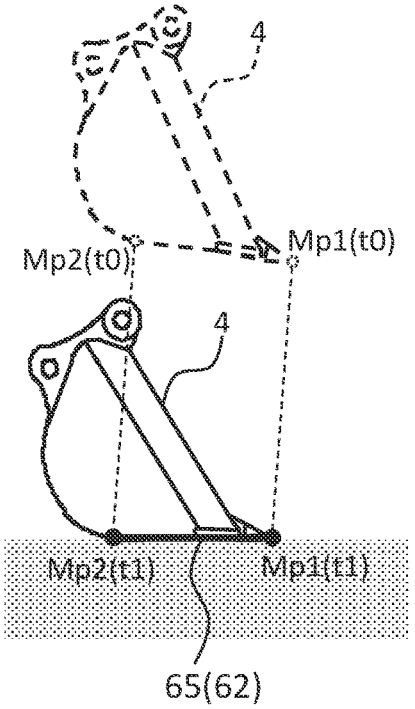

Here, suppose that five monitoring points Mp1 to Mp5 are set along the external shape of a side surface of the bucket 4 as in FIG. 19. Of these, Mp1 is a monitoring point set to the claw tip of the bucket 4 (first point), and Mp2 is a monitoring point set to a rear end of the bottom surface of the bucket (second point). Incidentally, suppose that the "bottom surface of the bucket" in the present document is a region from the monitoring point Mp1 to the monitoring point Mp2.

Case of Excavating Operation

When the result of the operation determination is the excavating operation, the partial shape data generating section 4023 selects, as the ground contact region, a first ground contact region Ga1 which is a predetermined region including at least the bucket claw tip (see FIG. 19). Of the five monitoring points Mp1 to Mp5 depicted in FIG. 19, only the monitoring point Mp1 belongs to the first ground contact region Ga1. As depicted in FIG. 20(*a*), the partial shape data generating section 4023 generates the movement locus 63 from time t0 to t1 of the monitoring point Mp1 as the partial shape data 65. Incidentally, when the first ground contact region Ga1 includes a plurality of monitoring points, data obtained by further adding the first external shape 61 to the above-described movement locus 63 may be set as the partial shape data 65.

Case of Tamping Operation

When the result of the operation determination is the tamping operation, the partial shape data generating section 4023 selects, as the ground contact region, a second ground contact region Ga2 which is a predetermined region including at least the rear end of the bottom surface of the bucket (see FIG. 19). Of the five monitoring points Mp1 to Mp5 depicted in FIG. 19, only the monitoring point Mp2 belongs to the second ground contact region Ga2. As depicted in FIG. 20(*b*), the partial shape data generating section 4023 generates the movement locus 63 from time t0 to t1 of the monitoring point Mp2 as the partial shape data 65. Incidentally, when the second ground contact region Ga2 includes a plurality of monitoring points, data obtained by further adding the second external shape 62 to the above-described movement locus 63 may be set as the partial shape data 65.

Case of Bumping Operation

When the result of the operation determination is the bumping operation, the partial shape data generating section 4023 selects, as the ground contact region, a third ground contact region Ga3 which is a predetermined region including at least the bucket claw tip and the rear end of the bottom surface of the bucket (see FIG. 19). Of the five monitoring points Mp1 to Mp5 depicted in FIG. 19, two monitoring points Mp1 and Mp2 belong to the third ground contact region Ga3. As depicted in FIG. 20(*c*), the partial shape data generating section 4023 generates, as the partial shape data 65, a line segment connecting the two monitoring points Mp1 and Mp2 to each other (that is, the second external shape 62) at time t1 (second time).

Concrete Example of Processing Flow

One flow of concrete processing by the ground contact state determining section 4021 and the partial shape data generating section 4023 when the partial shape data generating section 4023 adopts the first generating method will be described in the following with reference to a flowchart of FIG. 17. Incidentally, for details of each piece of processing, see the foregoing description.

First, the ground contact state determining section 4021 obtains the position data and the posture data of the work device 1A and the machine body 1B, the position data and the posture data being computed by the work implement posture computing section 4011, the machine body position computing section 4012, and the machine body angle computing section 4013 (S170). Next, the ground contact state determining section 4021 determines whether or not the position of the bucket 4 is changed, on the basis of the data obtained in S170 (S171). When it is determined in S171 that the bucket position is changed, the processing proceeds to S172. When it is determined that the bucket position is not changed, on the other hand, the processing returns to S170.

In S172, the ground contact state determining section 4021 computes the reaction force F from the ground by using the position data and the posture data of the work device 1A and the machine body 1B, the position data and the posture data being obtained in S170, and data on the hydraulic operating fluid pressures Pr and Pb of the boom cylinder 5 (pressure data), the pressure data being output from the pressure sensors 19. When the computed reaction force F is equal to or more than a predetermined threshold value, it is determined that the bucket 4 is in the ground contact state, and the processing proceeds to S174. When the reaction force F is less than the threshold value, on the other hand, it is determined that the bucket 4 is not in contact with the ground, and the processing returns to S170.

In S174, the partial shape data generating section 4023 is supplied with, as input, the position data of the plurality of monitoring points Mpm set to the bucket 4 (see FIG. 19) from the monitoring point position computing section 4022.

In S175, the partial shape data generating section 4023 computes a distance between each monitoring point Mpm and the target surface (target surface distance) on the basis of the position data of each monitoring point Mpm, which is supplied as input in S174, and the target surface data stored in the storage device 4062.

In S176, the partial shape data generating section 4023 determines which of the excavating operation, the tamping operation, and the bumping operation an operation of the work device 1A is, on the basis of operation amounts of the operation levers 11*a* and 11*b* computed from the detection data of the operation amount sensors 20 and the target surface distance computed in S175.

In S177, the partial shape data generating section 4023 decides one ground contact region from among the three ground contact regions Ga1, Ga2, and Ga3 (see FIG. 20) set to the bucket 4, on the basis of the operation determined in S176.

In S178, the partial shape data generating section 4023 generates the partial shape data 65 on the basis of the movement locus 63 of the monitoring point belonging to the ground contact region decided in S177 or the second external shape 62 (see FIG. 20), and outputs the generated partial shape data 65 to the storage device 4062 to make the controller 100 store the partial shape data 65. When S178 is completed, the processing returns to S170.

Figure 17:
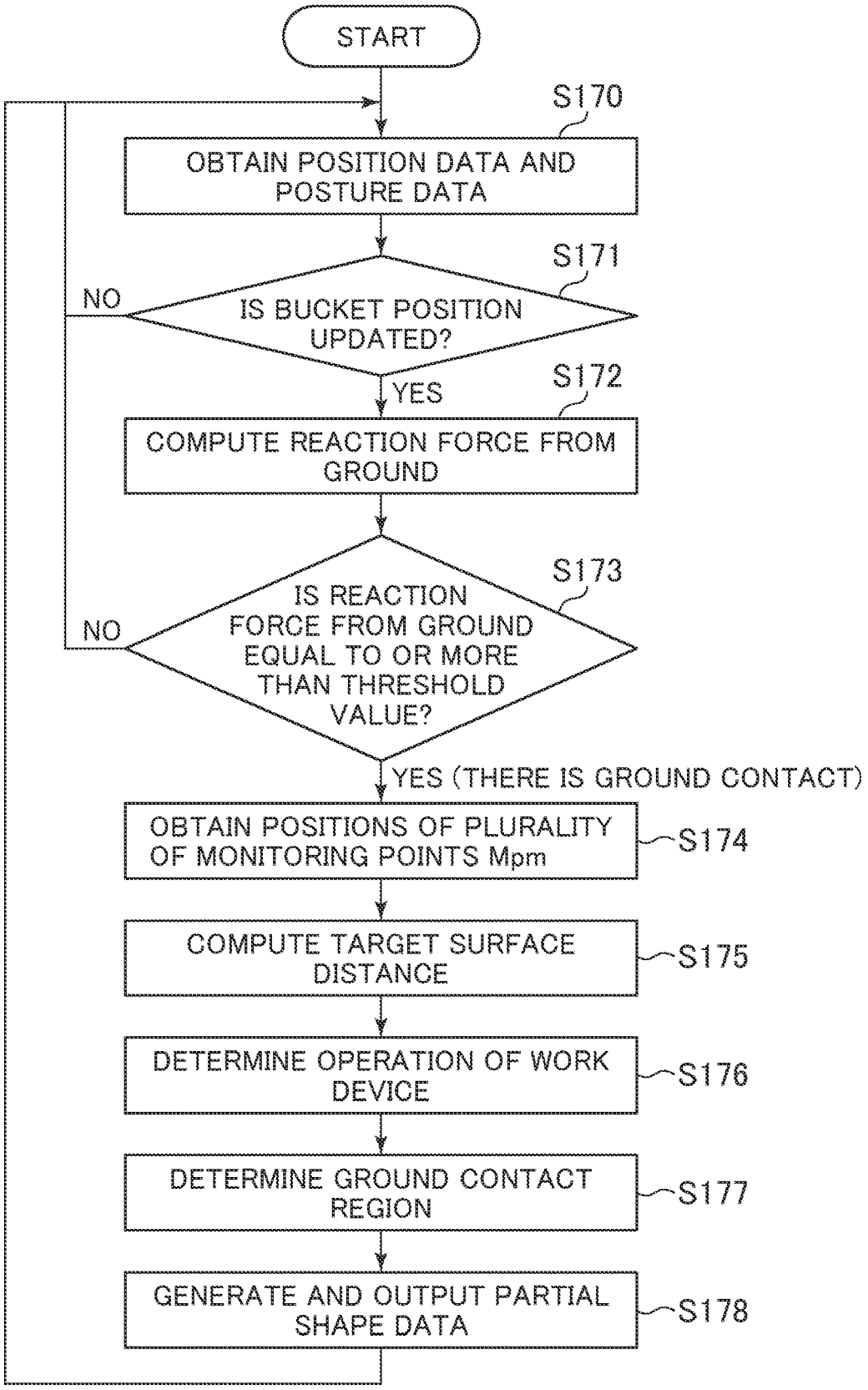
FIG. 17 represents an example of a flowchart of concrete processing by a controller (a ground contact state determining section and the partial shape data generating section) when a first generating method is adopted.

Incidentally, in the flow of FIG. 17, the position information of the monitoring points Mpm set to the bucket 4 is obtained when it is determined in S173 that the bucket 4 is in the ground contact state. However, the position information of the monitoring points Mpm may be obtained in advance irrespective of the ground contact state of the bucket 4, the processing of determining the ground contact state of the bucket 4 may be performed in parallel with the obtainment of the position information, and time information at which the bucket 4 is determined to be in the ground contact state may be stored in advance, Incidentally, in the flow of FIG. 17, description has been made supposing that the processing of S174 to S178 is performed when it is determined in S173 that the bucket 4 is in the ground contact state. However, the processing of determining the ground contact state (S172 and S173) may be skipped to perform the processing of S174 to S178 after completion of S171, the processing of determining the ground contact state (S172 and S173) may, for example, be performed at predetermined intervals in a separate and independent flow, and processing of deleting, from the storage device 4062, the partial shape data generated in a state in which the bucket 4 is not in the ground contact state may be performed. In addition, the processing of S170 and S171 may be similarly made independent, and processing of deleting, from the storage device 4062, the partial shape data generated in a state in which the bucket position is not changed may be performed.

(Second Method of Generating Partial Shape Data)

A second generating method will be described with reference to FIGS. 9 to 12. The partial shape data generating section 4023 generates partial shape data by using one of methods depicted in FIGS. 9 to 12.

Figure 9:
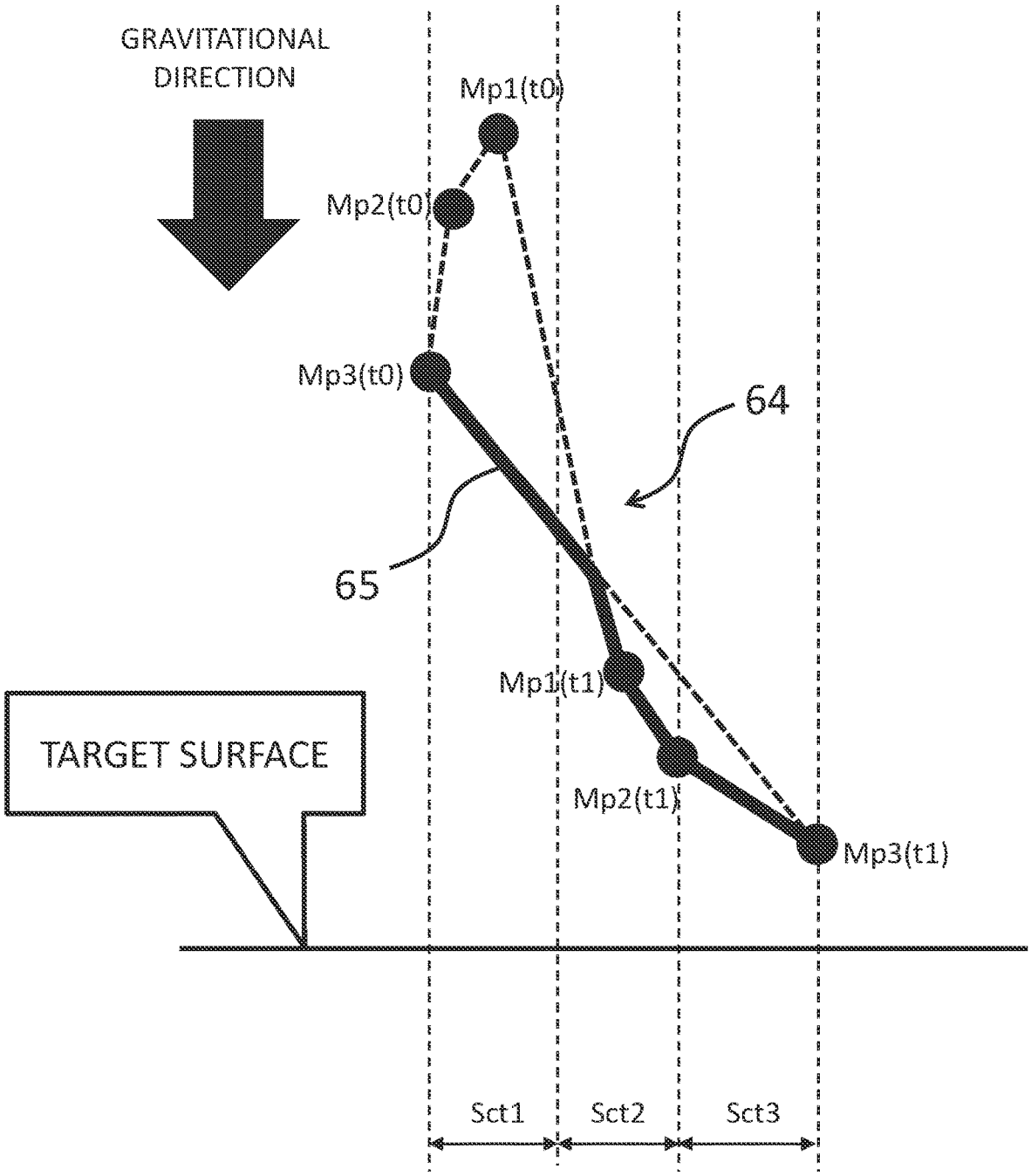
FIG. 9 is a diagram depicting an example of a process of generating partial shape data by a partial shape data generating section when a second generating method is adopted.

In the example of FIG. 9, the partial shape data generating section 4023 divides the bucket passage region 64 as a region enclosed by the first external shape 61, the second external shape 62, and the movement loci 63 into a plurality of sections in a horizontal direction (three sections Sct1, Sct2, and Sct3 in the example of FIG. 9). Generally, when the bucket passage region 64 is divided into such a plurality of sections, a plurality of line segments are present in each section. In that case, there is a problem of which line segment to select in each section to generate the partial shape data. Accordingly, in the example of FIG. 9, the partial shape data generating section 4023 generates the partial shape data 65 on the basis of a line segment located on a lower side in a gravitational direction in each of the sections Sct1, Sct2, and Sct3 having been divided.

Figure 10:
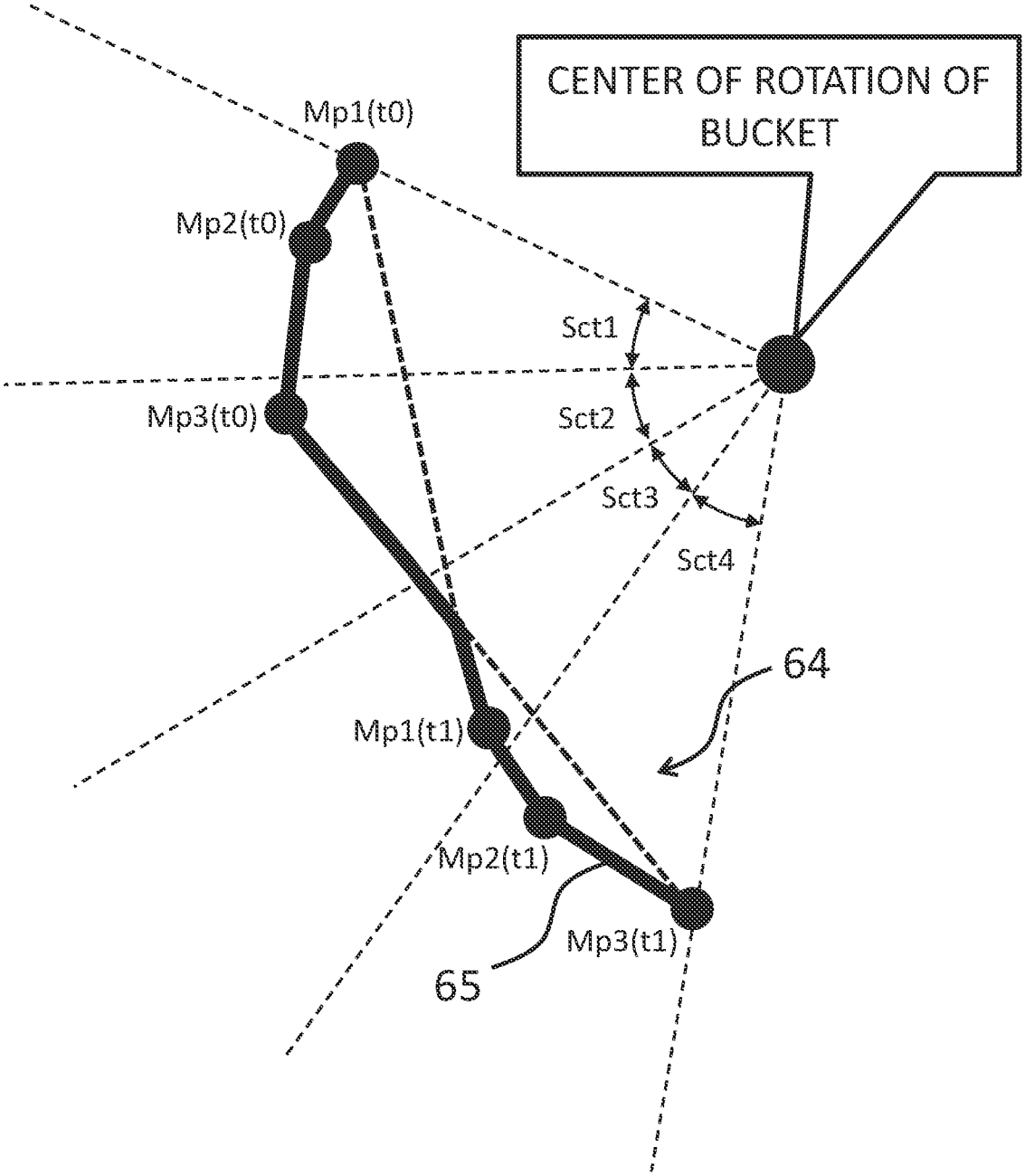
FIG. 10 is a diagram depicting an example of the process of generating the partial shape data by the partial shape data generating section when the second generating method is adopted.

In the example of FIG. 10, the partial shape data generating section 4023 divides the bucket passage region 64 as a region enclosed by the first external shape 61, the second external shape 62, and the movement loci 63 into a plurality of sections (four sections Sct1, Sct2, Sct3, and Sct4 in the example of FIG. 10) by a plurality of radial straight lines passing through a center of rotation of the bucket 4 (bucket pin). The partial shape data generating section 4023 generates the partial shape data 65 on the basis of a line segment farthest from the center of rotation of the bucket 4 in each of the sections Sct1, Sct2, Sct3, and Sct4 having been divided. When the partial shape data 65 is generated in this manner, the partial shape data of an appropriate shape can be generated even when the target surface has an inclination close to the vertical or an inclination exceeding the vertical (overhanging state). Incidentally, while the center of rotation of the bucket 4 is set as a reference point here, a center of rotation of the arm 3 (arm pin) may be set as the reference point.

Figure 11:
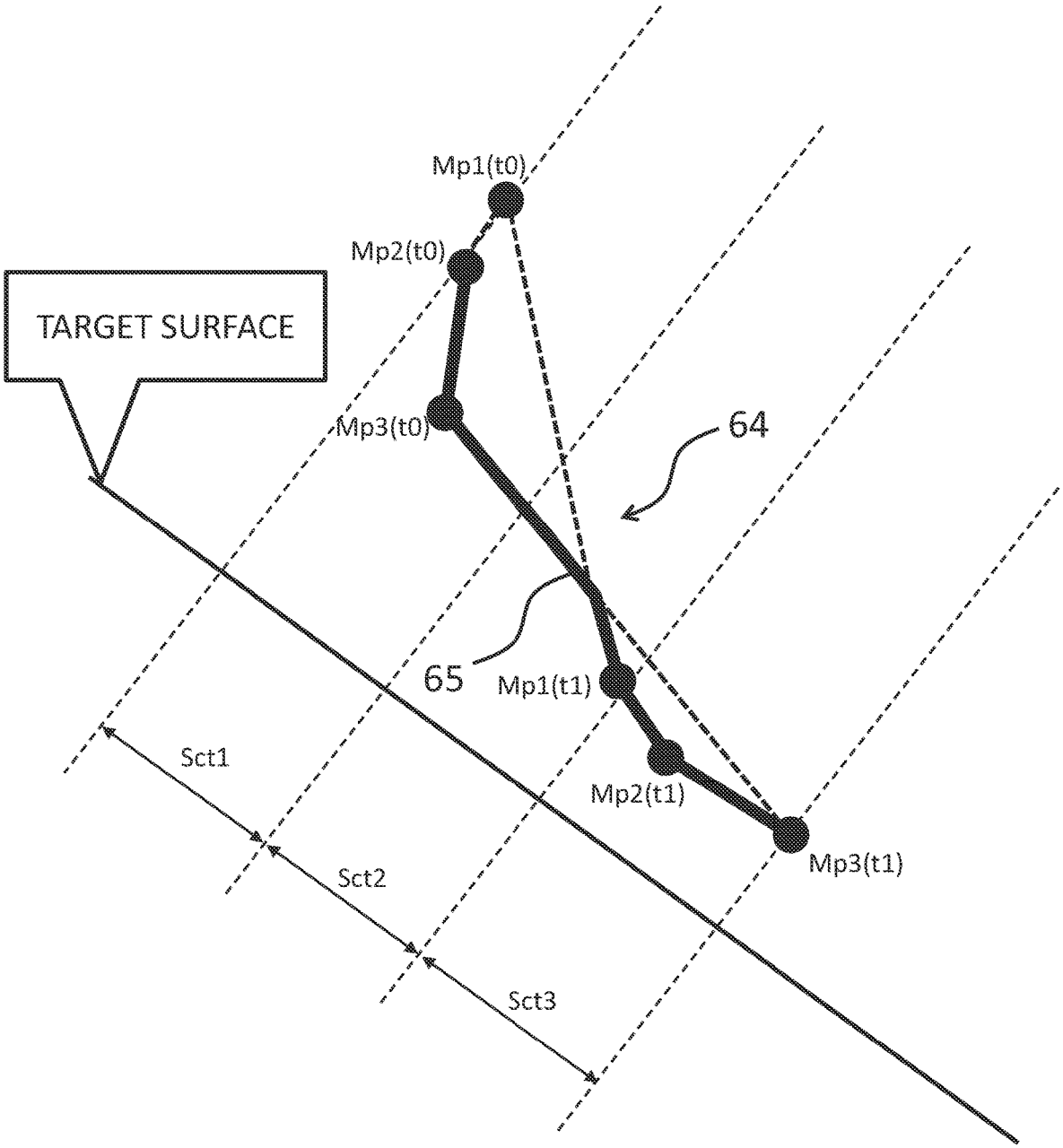
FIG. 11 is a diagram depicting an example of the process of generating the partial shape data by the partial shape data generating section when the second generating method is adopted.

In the example of FIG. 11, the partial shape data generating section 4023 divides the bucket passage region 64 as a region enclosed by the first external shape 61, the second external shape 62, and the movement loci 63 into a plurality of sections (three sections Sct1, Sct2, and Sct3 in the example of FIG. 11) in a direction along the extending direction of the target surface. The partial shape data generating section 4023 generates the partial shape data 65 on the basis of a line segment closest to the target surface in each of the sections Sct1, Sct2, and Sct3 having been divided.

Figure 12:
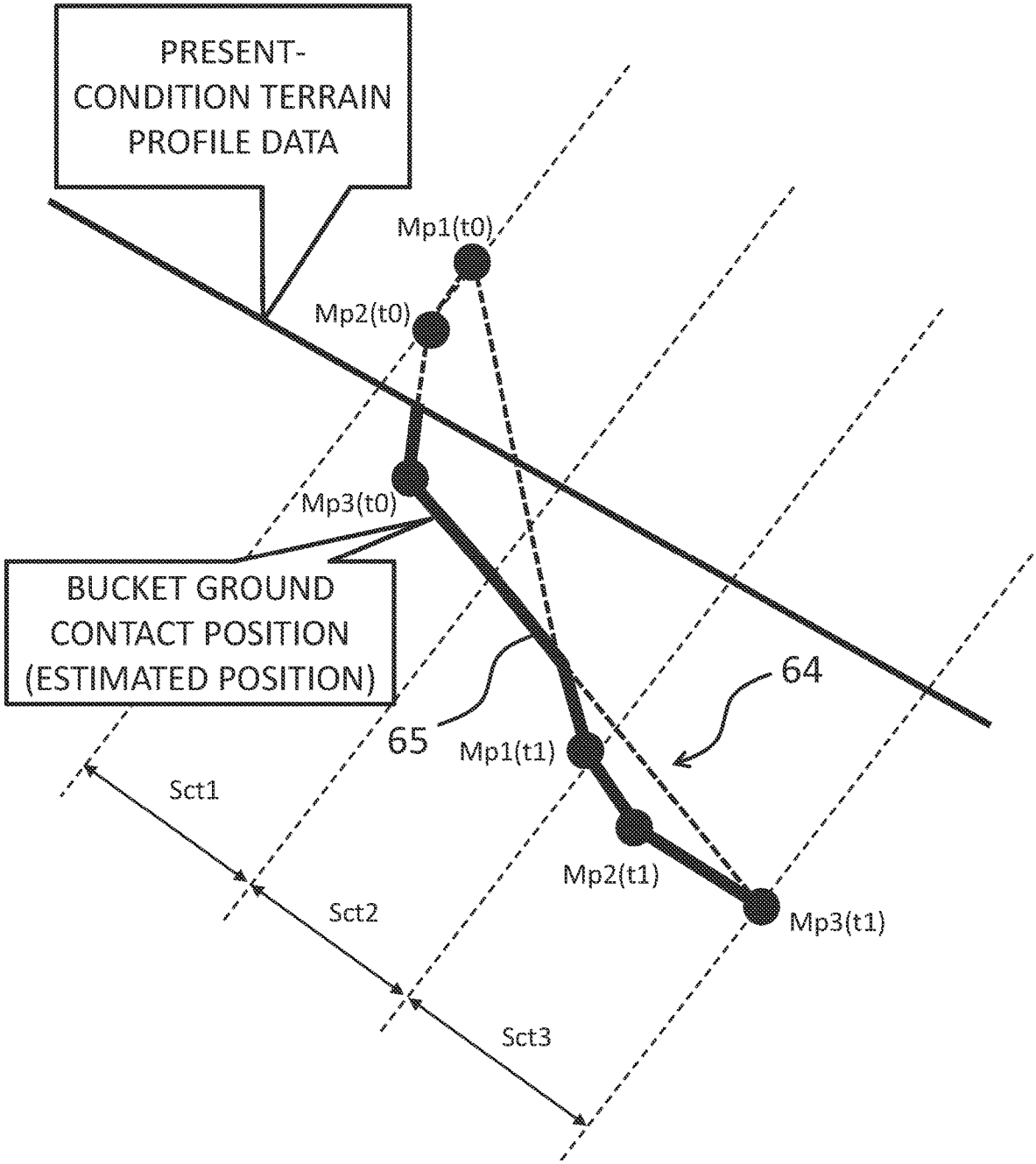
FIG. 12 is a diagram depicting an example of the process of generating the partial shape data by the partial shape data generating section when the second generating method is adopted.

In the example of FIG. 12, the partial shape data generating section 4023 divides the bucket passage region 64 as a region enclosed by the first external shape 61, the second external shape 62, and the movement loci 63 into a plurality of sections (three sections Sct1, Sct2, and Sct3 in the example of FIG. 12) in a direction along the extending direction of the present-condition terrain profile defined by the present-condition terrain profile data in the storage device 4062 (present-condition terrain profile on the controller 100). The partial shape data generating section 4023 generates the partial shape data 65 on the basis of a line segment located below the present-condition terrain profile defined by the present-condition terrain profile data in the storage device 4062 and farthest from the present-condition terrain profile in each of the sections Sct1, Sct2, and Sct3 having been divided.

The partial shape data 65 generated by the partial shape data generating section 4023 as described above is stored in the storage device 4062 in the controller 100.

Incidentally, while the first generating method and the second generating method have been described separately from each other in the above description, the partial shape data 65 may be generated by performing both. As for order in that case, either method may be performed first. In addition, the partial shape data 65 obtained as described above can be output to the present-condition terrain profile data generating section 4032 in a format such as an equation of a surface, surface information such as the order of the coordinates of vertices and sides connecting the vertices or the like, or the coordinates of a point group on a surface defined by the partial shape data 65.

(Present-Condition Terrain Profile Data Generating Section 4032)

The present-condition terrain profile data generating section 4032 updates the present-condition terrain profile data (present-condition shape data) of the work object, which is stored in the storage device 4062, on the basis of a plurality of pieces of partial shape data 65 generated by the partial shape data generating section 4023. In the following, description will be made of some of methods of generating the present-condition terrain profile data by the present-condition terrain profile data generating section 4032. However, generating methods other than those described in the following may be used.

Figure 13:
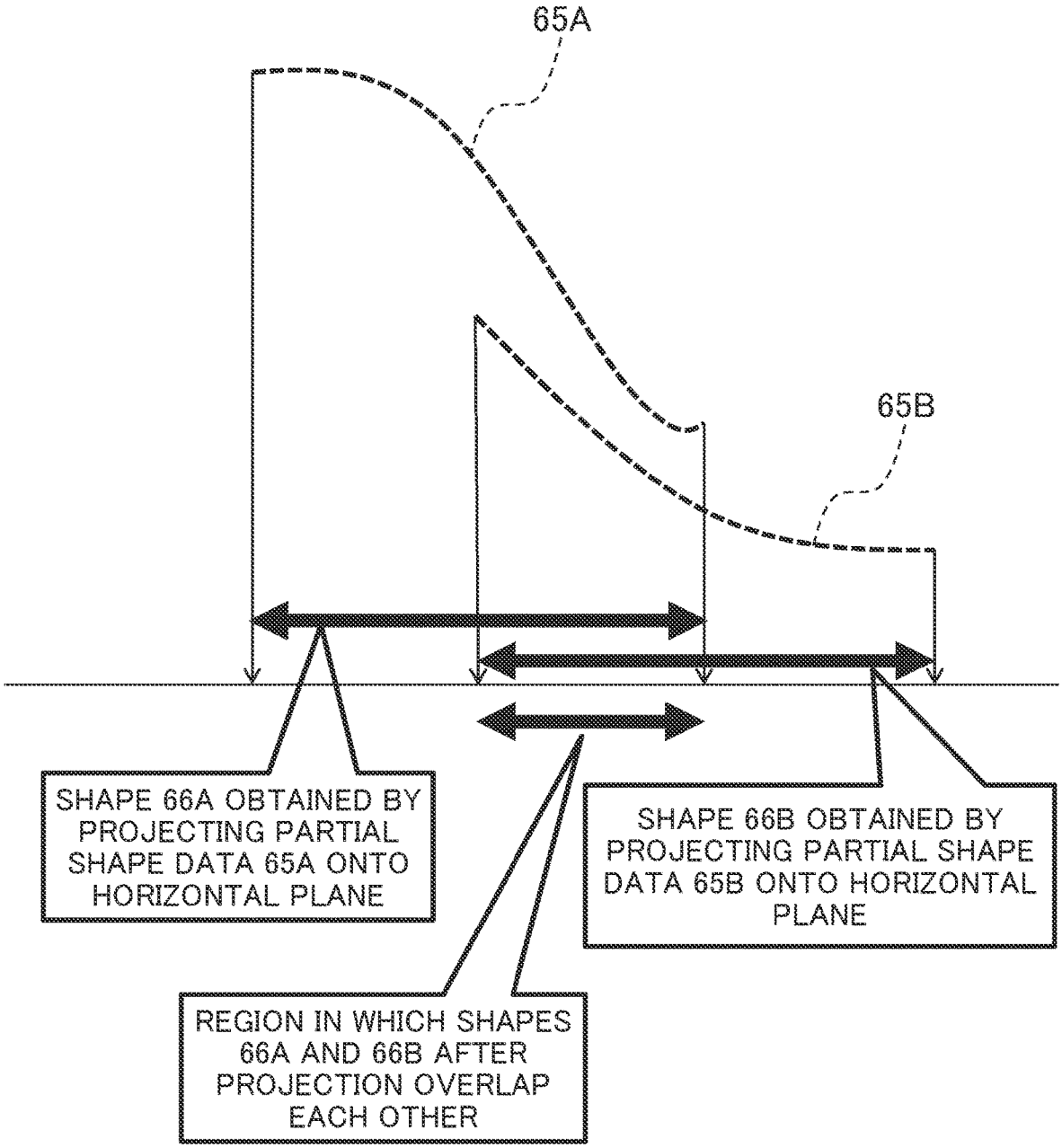
FIG. 13 is a diagram depicting an example of processing of generating present-condition terrain profile data, which is performed by a present-condition terrain profile data generating section.
Figure 14:
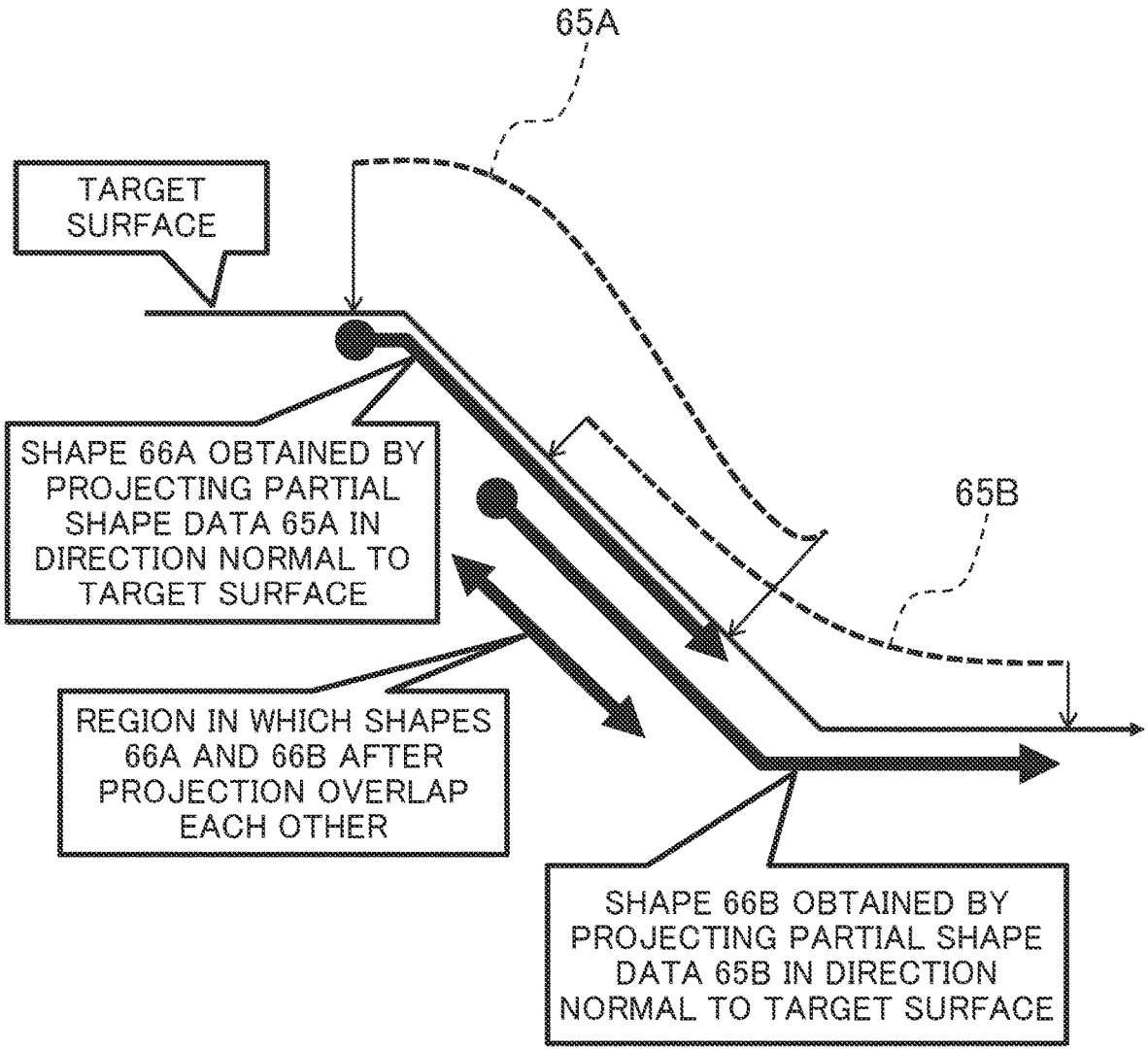
FIG. 14 is a diagram depicting an example of the processing of generating the present-condition terrain profile data, which is performed by the present-condition terrain profile data generating section.

The present-condition terrain profile data generating section 4032 first performs filtering on the plurality of pieces of partial shape data 65 recorded in the storage device 4062 for objects of terrain profile formation processing as processing of generating the present-condition terrain profile data, by using a generation time of each piece of partial shape data 65 (which time may be a computation time of the positions of the monitoring points constituting each piece of partial shape data 65), an operation determination result, a ground contact region selection result, the target surface distance, and the like. Next, the present-condition terrain profile data generating section 4032 determines whether or not a plurality of pieces of partial terrain profile data (bucket loci) 65 set as objects of the terrain profile formation processing by the filtering have an overlapping part. This overlap determination is made by projecting each piece of partial shape data 65A and 65B onto the horizontal plane (FIG. 13) or projecting each piece of partial shape data 65A and 65B in a direction normal to the target surface (FIG. 14), and determining whether shapes 66A and 66B after the projection have an overlapping region. The whole of partial shape data 65 not overlapping other partial shape data 65 at all is adopted as the present-condition terrain profile data. On the other hand, as for partial shape data 65 overlapping other partial shape data 65, a part or the whole of the partial shape data satisfying a predetermined extraction condition (partial shape extraction condition) to be described in the following is extracted, and the extracted part or whole of the partial shape data is adopted as the present-condition terrain profile data.

As the above-described extraction condition, there is, for example, a condition that compares the position information of each piece of partial shape data 65, and adopts, as the present-condition terrain profile data, a part whose position in a vertical direction is lowest, a part whose position in the vertical direction is highest, a part whose distance in the vertical direction to the target surface (target surface distance) is a minimum, a part whose distance in the direction normal to the target surface is a minimum, or a part whose distance in the direction normal to the target surface is a maximum. Alternatively, there is a condition that compares the generation time of each piece of partial shape data 65 (that is, an estimated time of construction work performed by the bucket 4), and adopts partial shape data having an oldest time or having a latest time as the present-condition terrain profile data.

Figure 18:
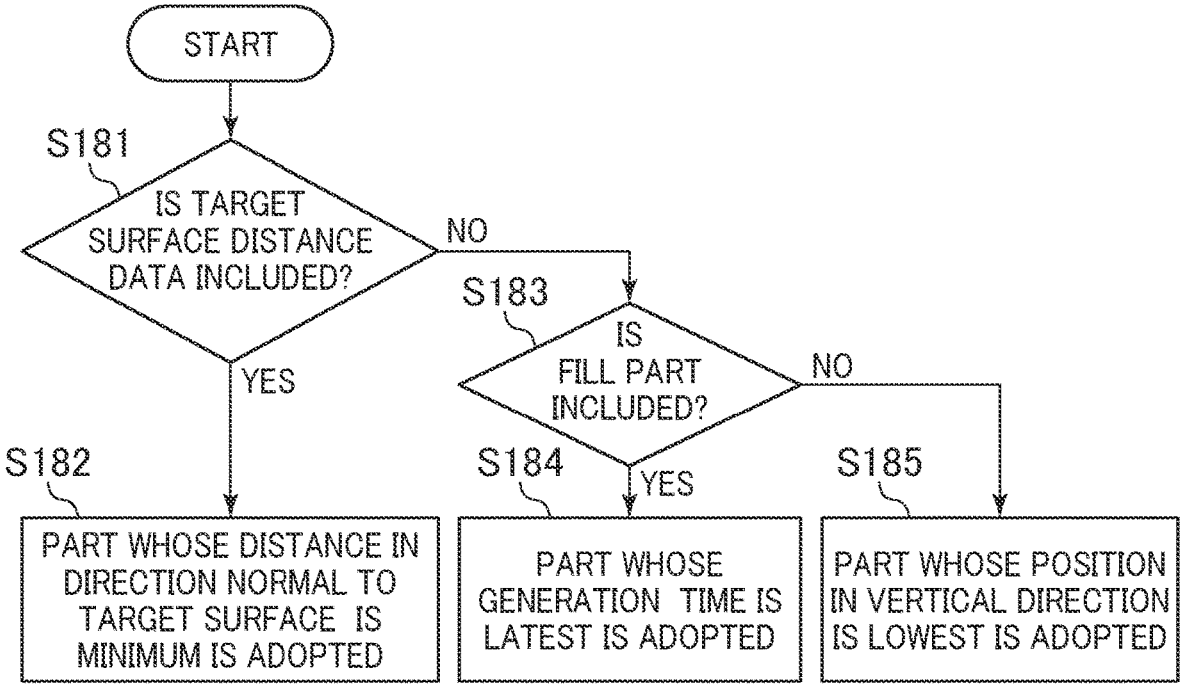
FIG. 18 represents an example of a flowchart for selecting an extraction condition used when the partial shape data has an overlapping part.

One concrete example of the extraction condition is depicted in FIG. 18. First, the controller 100 (present-condition terrain profile data generating section 4032) determines whether or not all pieces of the partial shape data 65 set as objects for checking whether or not the extraction condition is satisfied include data on the target surface distance (S181). When the target surface distance data is included, the present-condition terrain profile is considered to gradually approach the target surface, and therefore a part whose distance to the target surface is a minimum in the direction normal to the target surface is adopted as the present-condition terrain profile data (S182).

When the determination in S181 indicates that there is partial shape data 65 not including the target surface distance data, the controller 100 (present-condition terrain profile data generating section 4032) determines whether or not the partial shape data 65 set as objects for checking whether or not the extraction condition is satisfied includes a fill part (S183). When a fill part is included, the height of the present-condition terrain profile can be repeatedly increased and decreased, and therefore the condition of a generation time instead of the condition of a height direction, that is, data having a latest generation time in the overlapping part is adopted as the present-condition terrain profile data (S184).

When the determination in S183 determines that there is no fill part (that is, when it is determined that only a cut earth part is present), the height of the present-condition terrain profile is considered to change in a decreasing direction at all times, and therefore a part whose position in the vertical direction is lowest is adopted as the present-condition terrain profile data (S185).

Figure 15:
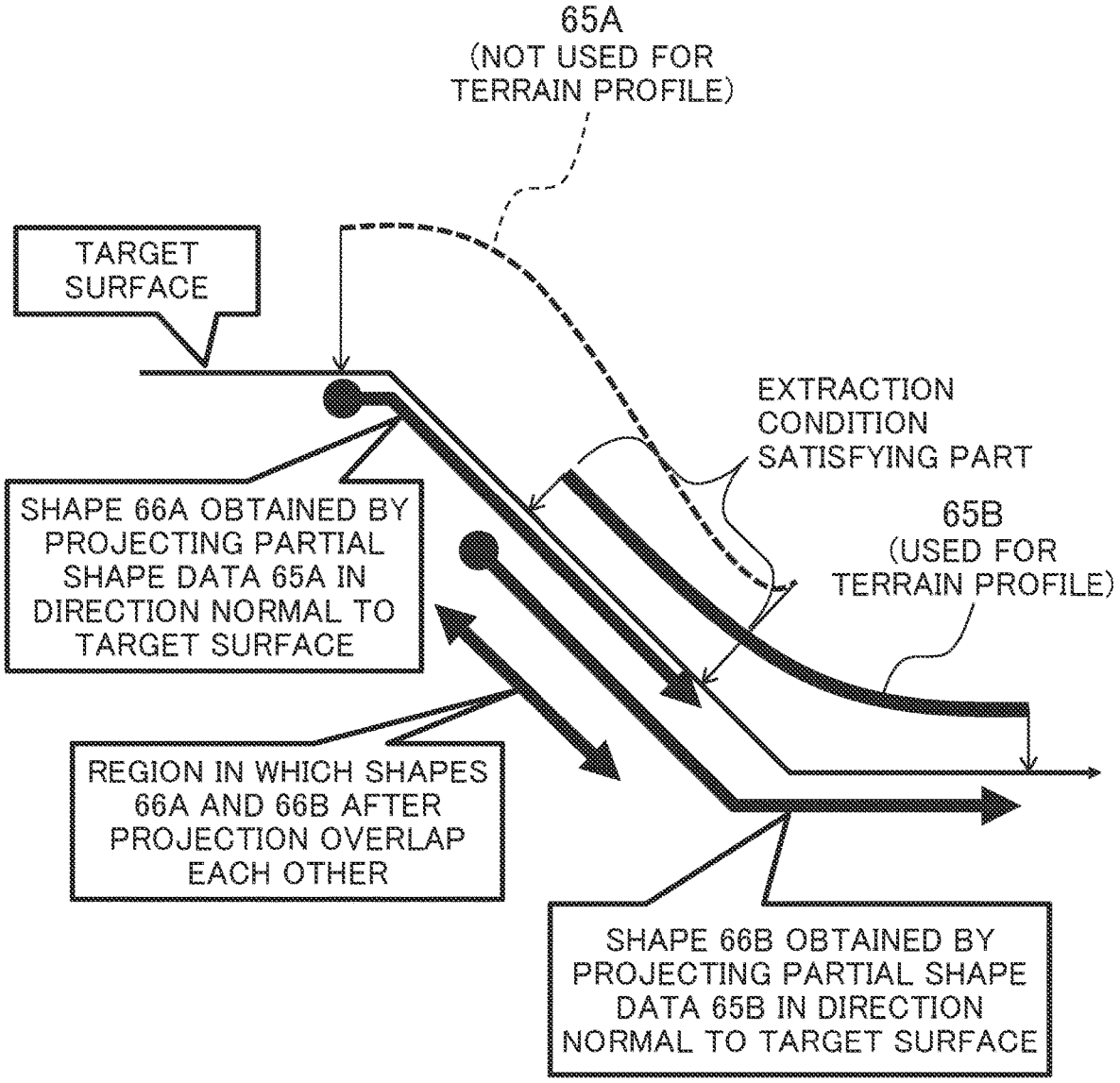
FIG. 15 is a diagram depicting an example of the processing of generating the present-condition terrain profile data, which is performed by the present-condition terrain profile data generating section.
Figure 16:
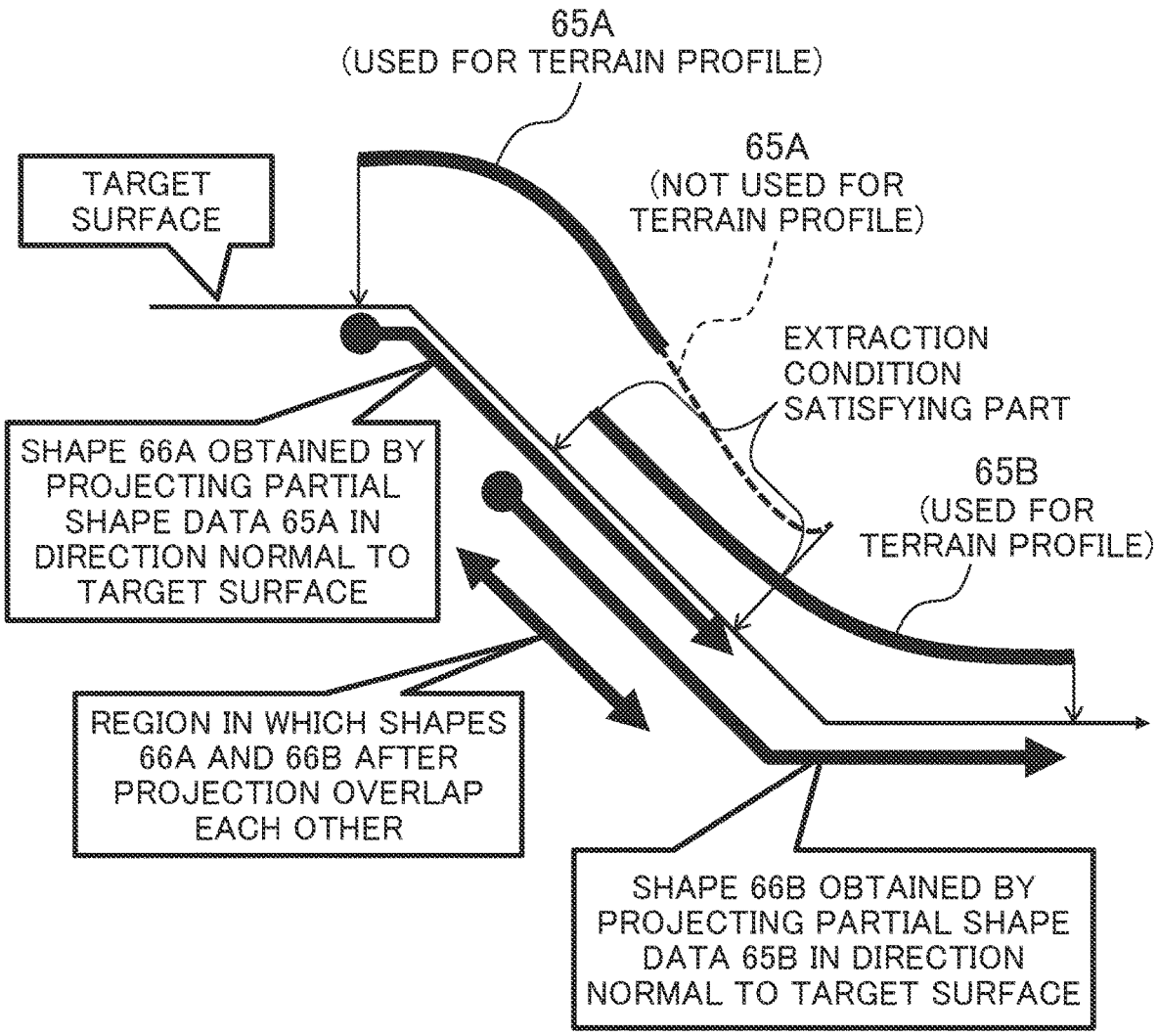
FIG. 16 is a diagram depicting an example of the processing of generating the present-condition terrain profile data, which is performed by the present-condition terrain profile data generating section.

Incidentally, while the above description has mentioned handling of a part in which the two pieces of partial shape data 65 overlap each other (that is, a part in which the satisfaction of the extraction condition is confirmed), a part in which the two pieces of partial shape data 65 do not overlap each other (remaining part in which the satisfaction of the extraction condition is not confirmed) can be handled as follows. Specifically, as depicted in FIG. 15, the whole of data to which a part satisfying the extraction condition in the two pieces of partial shape data 65A and 65B belongs (that is, the whole of the partial shape data 65B in FIG. 15) can be adopted as terrain profile data. In addition, as depicted in FIG. 16, the whole of data to which the part satisfying the extraction condition in the two pieces of partial shape data 65A and 65B belongs (that is, the whole of the partial shape data 65B in FIG. 16) can be adopted as terrain profile data, and as for data to which a part not satisfying the extraction condition belongs (that is, the partial shape data 65A in FIG. 16), a part in which no overlap occurs (solid line part of the partial shape data 65A in FIG. 16) can also be adopted as terrain profile data.

The present-condition terrain profile data generating section 4032 updates the present-condition terrain profile data by outputting the present-condition terrain profile data generated as described above to the storage device 4062 and making the present-condition terrain profile data stored in the controller 100. When the present-condition terrain profile data is output to the storage device 4062, the present-condition terrain profile data may, for example, be converted into point group data or TIN (triangulated irregular network) data. The present-condition terrain profile data may be output not only to the controller 100 in the hydraulic excavator 1 but also to a device external to the hydraulic excavator 1 (for example, a server or the like).

(Progress Management Information Generating Section 404)

The progress management information generating section 404 is supplied with, as input, the present-condition terrain profile data in the storage device 4062, the present-condition terrain profile data being updated by the present-condition terrain profile data generating section 4032, generates progress management information including a latest present-condition terrain profile, a completed amount on a site and a completed amount of each excavator on a specified date or in a specified period, a work progress rate on the entire site and a work progress rate of each excavator (each operator), position information of a part where construction is completed (completed construction part), and the like, and presents the generated information to a user including the operator of the hydraulic excavator 1 via the monitor 405 or the like. Incidentally, a part of the information processing and the information presentation by the progress management information generating section 404 may be displayed on not only the monitor 405 installed on the hydraulic excavator 1 but also a device such as a smart phone, a tablet, or a personal computer that is present outside the hydraulic excavator 1.

(Effects)

(1) The hydraulic excavator 1 configured as described above generates the partial shape data 65 on the basis of the external shapes 61 and 62 and the movement loci 63 defined by the positions of the monitoring points Mpm in a period in which the work device 1A is in contact with the ground (in the ground contact period). Thus, the loci of the monitoring points Mpm when the work device 1A is operated in the air are not recorded as the present-condition terrain profile data, so that accurate present-condition terrain profile data closer to an actual terrain profile than conventional can be generated.

(2) The above-described hydraulic excavator 1 determines the operation of the work device 1A on the basis of the operation amounts and the target surface distance, and selects a monitoring point(s) Mpm to be used to generate the partial shape data, on the basis of a ground contact region decided according to the operation determination. Thus, present-condition terrain profile data which is more accurate than conventional can be generated. With regard to this point, the above-described technology of Patent Document 1 can detect only the excavating operation, and cannot detect the tamping operation using an arm dumping operation and a boom lowering operation or the like. In addition, even in situations in which the same arm crowding operation is performed, a monitoring point to be recorded differs, such as a monitoring point at the bucket claw tip in the excavating operation and a monitoring point at the back surface of the bucket in the tamping operation. However, Patent Document 1 does not particularly describe a monitoring point setting method.

(3) The above-described hydraulic excavator 1 determines which of the excavating operation, the tamping operation, and the bumping operation an operation of the work device 1A is, and selects a monitoring point(s) Mpm to be used to generate the partial shape data, by using a ground contact region corresponding to a result of the determination. Thus, present-condition terrain profile data which is more accurate than conventional can be generated.

(4) The above-described hydraulic excavator 1 generates the partial shape data 65 on the basis of at least a movement locus 63 when it is determined that the operation of the work device 1A is the excavating operation, generates the partial shape data 65 on the basis of at least a movement locus 63 when it is determined that the operation of the work device 1A is the tamping operation, and generates the partial shape data 65 on the basis of the second external shape 62 when it is determined that the operation of the work device 1A is the bumping operation. Thus, computation based on unnecessary monitoring points Mpm is prevented from being performed in each operation, so that efficiency of generation of the partial shape data 65 can be improved.

(5) When there are a plurality of candidates for the partial shape data 65, the partial shape data 65 is generated on the basis of a line segment located on a lower side in the gravitational direction as in the example depicted in FIG. 9. Thus, present-condition terrain profile data which is more accurate than conventional can be generated.

(6) When there are a plurality of candidates for the partial shape data 65, the partial shape data 65 is generated on the basis of a line segment farthest from the center of rotation of the bucket 4 or the arm 3 as in the example depicted in FIG. 10. Thus, present-condition terrain profile data which is more accurate than conventional can be generated. This method exerts a remarkable effect particularly when the angle of the target surface is close to the vertical (90 degrees) or when the angle of the target surface is equal to or more than 90 degrees.

(7) When there are a plurality of candidates for the partial shape data 65, the partial shape data 65 is generated on the basis of a line segment closest to the target surface in the direction normal to the target surface as in the example depicted in FIG. 11. Thus, present-condition terrain profile data which is more accurate than conventional can be generated.

(8) When there are a plurality of candidates for the partial shape data 65, the partial shape data 65 is generated on the basis of a line segment located below the present-condition terrain profile on the controller 100 and farthest from the present-condition terrain profile on the controller 100 as in the example depicted in FIG. 12. Thus, present-condition terrain profile data which is more accurate than conventional can be generated.

(Others)

In the above description, the receiver 4012 that computes the position of the machine body 1B on the basis of a plurality of navigation signals transmitted from a plurality of positioning satellites is used as the machine body position computing device for computing the position of the machine body 1B. However, the position of the machine body 1B may be computed by, for example, attaching a plurality of targets (prisms) to the machine body 1B, and measuring distances to the plurality of targets by a total station. That is, the total station can also be used as the machine body position computing device.

It is to be noted that the present invention is not limited to the foregoing embodiment, but includes various modifications within a scope not departing from the spirit of the present invention. For example, the present invention is not limited to including all of the configurations described in the foregoing embodiment, but includes configurations obtained by omitting some of the configurations. In addition, some of configurations according to a certain embodiment can be added to or replaced with a configuration according to another embodiment.

In addition, a part or the whole of each configuration of the controller 100 described above and functions, execution processing, and the like of each such configuration may be implemented by hardware (for example, by designing logic for performing each function by an integrated circuit). In addition, the configurations of the controller 100 described above may be a program (software) that implements each function of the configurations of the controller 100 by being read and executed by the computation processing device (for example, a CPU) 4061. Information related to the program can be stored in, for example, a semiconductor memory (a flash memory, an SSD, or the like), a magnetic storage device (a hard disk drive or the like), and a recording medium (a magnetic disk, an optical disk, or the like), and the like.

In addition, in the description of the foregoing embodiment, control lines and information lines construed as necessary for the description of the embodiment are illustrated. However, not all of control lines and information lines of a product are necessarily illustrated. Almost all configurations may be considered to be actually interconnected.

DESCRIPTION OF REFERENCE CHARACTERS

1: Hydraulic excavator
1A: Work device (front work device)
1B: Machine body
1BA: Upper swing structure
1BB: Lower track structure
2: Boom
3: Arm
4: Bucket
5: Boom cylinder
6: Arm cylinder
7: Bucket cylinder
11*a*: Operation lever
11*b*: Operation left lever
12: Boom angle sensor
13: Arm angle sensor
14: Bucket angle sensor
16*a*: Machine body forward-rearward inclination angle sensor (pitch angle sensor)
16*b*: Machine body left-right inclination angle sensor (roll angle sensor)
17*a*: First GNSS antenna
17*b*: Second GNSS antenna
19: Pressure sensor
20: Operation amount sensor
21: Target surface data input device
22: Present-condition terrain profile data input device
41: Operation plane
45: Monitor
61: First external shape
62: Second external shape
63: Movement locus
64: Bucket passage region (work device passage region)
65: Partial shape data
100: Controller
404: Progress management information generating section
405: Monitor
4011: Work implement posture computing section
4012: Machine body position computing section (receiver)
4013: Machine body angle computing section
4021: Ground contact state determining section
4022: Monitoring point position computing section
4023: Partial shape data generating section
4032: Present-condition terrain profile data generating section
4061: Computation processing device (for example, a CPU)
4062: Storage device

The invention claimed is:

1. A work machine comprising:
a machine body;
a work device attached to the machine body, the work device having an attachment at a distal end thereof;
a machine body position computing device configured to compute a position of the machine body;
a posture sensor that detects a posture of the work device;
a pressure sensor that detects driving states of a plurality of hydraulic actuators that drive the work device; and
a controller configured to compute position information of a monitoring point set to the attachment, on a basis of the position of the machine body, the machine body position being computed by the machine body position computing device, and a position of the work device, the work device position being computed from detection data of the posture sensor, and update present-condition shape data of a work object of the work device by using the position information;
the controller being configured to
determine whether or not the attachment is in a ground contact state, by using detection data of the pressure sensor and at least one balance relation between forces or moments acting on the work device, and
generate partial shape data of the work object formed by the attachment, on a basis of a movement locus of the monitoring point set to the attachment and an external shape of the attachment in a ground contact period in which the attachment is determined to be in the ground contact state, and update the present-condition shape data of the work object on a basis of the partial shape data.

2. The work machine according to claim 1, wherein
a plurality of the monitoring points are set to the attachment, and
the external shape is defined by positions of the plurality of monitoring points.

3. The work machine according to claim 2, wherein
the controller is configured to
generate the partial shape data on a basis of a first external shape defined by the positions of the plurality of monitoring points at a first time in the ground contact period in which the attachment is determined to be in the ground contact state, a second external shape defined by the positions of the plurality of monitoring points at a second time later than the first time in the ground contact period, and movement loci of the plurality of monitoring points in a period from the first time to the second time.

4. The work machine according to claim 2, further comprising:
an operation lever for operating the work device, wherein
the controller stores a target surface on which a target shape of a construction object of the work device is defined,
the controller is configured to
make a determination of an operation of the work device on a basis of data including an operation amount input to the operation lever and a target surface distance as a distance from the attachment to the target surface, and decide a ground contact region in which the attachment is estimated to be in contact with a ground from a result of the operation determination, and
the movement locus is a movement locus of a monitoring point belonging to the ground contact region among the plurality of monitoring points set to the attachment.

5. The work machine according to claim 4, wherein
the attachment is a bucket,
the plurality of monitoring points are a plurality of points set to the bucket, and the plurality of points include a first point set to a claw tip of the bucket and a second point set to a rear end of a bottom surface of the bucket, and the controller is configured to select a first ground contact region including the first point as the ground contact region when the result of the operation determination is an excavating operation, select a second ground contact region including the second point as the ground contact region when the result of the operation determination is a tamping operation, and select a third ground contact region including the first point and the second point as the ground contact region when the result of the operation determination is a bumping operation.

6. The work machine according to claim 5, wherein the controller is configured to generate the partial shape data on a basis of the movement locus when the result of the operation determination is the excavating operation, generate the partial shape data on a basis of the movement locus when the result of the operation determination is the tamping operation, and generate the partial shape data on a basis of the external shape defined by positions of the plurality of points in the ground contact period in which the work device is determined to be in the ground contact state, when the result of the operation determination is the bumping operation.

7. The work machine according to claim 3, wherein the controller is configured to divide a work device passage region as a region enclosed by the first external shape, the second external shape, and the movement loci into a plurality of sections in a horizontal direction, and generate the partial shape data on a basis of a line segment located on a lower side in a gravitational direction in each of the sections having been divided.

8. The work machine according to claim 3, wherein the attachment is a bucket, the plurality of monitoring points are a plurality of points set to the bucket, and the controller is configured to divide a work device passage region as a region enclosed by the first external shape, the second external shape, and the movement loci into a plurality of sections by a plurality of radial straight lines passing through a center of rotation of the bucket, and generate the partial shape data on a basis of a line segment farthest from the center of rotation of the bucket in each of the sections having been divided.

9. The work machine according to claim 3, wherein the controller stores a target surface on which a target shape of a construction object of the work device is defined, and the controller is configured to divide a work device passage region as a region enclosed by the first external shape, the second external shape, and the movement loci into a plurality of sections in a direction along the target surface, and generate the partial shape data on a basis of a line segment closest to the target surface in each of the sections having been divided.

10. The work machine according to claim 3, wherein the controller is configured to divide a work device passage region as a region enclosed by the first external shape, the second external shape, and the movement loci into a plurality of sections in a direction along a present-condition shape defined by the present-condition shape data, and generate the partial shape data on a basis of a line segment located below the present-condition shape and farthest from the present-condition shape in each of the sections having been divided.

11. The work machine according to claim 1, wherein the controller is configured to generate progress state data of work by the work device by using the present-condition shape data updated on a basis of the partial shape data, and the work machine further includes a monitor that displays the progress state data generated by the controller.

* * * * *